US006707427B2

(12) United States Patent
Konishi et al.

(10) Patent No.: US 6,707,427 B2
(45) Date of Patent: Mar. 16, 2004

(54) CHIP ANTENNA AND ANTENNA UNIT INCLUDING THE SAME

(75) Inventors: Takayoshi Konishi, Tokyo (JP); Takehiko Tsukiji, Fukuoka (JP)

(73) Assignee: NEC Microwave Tube, Ltd., Sagamiahara (JP)

( * ) Notice: Subject to any disclaimer, the term of this patent is extended or adjusted under 35 U.S.C. 154(b) by 0 days.

(21) Appl. No.: 10/059,423

(22) Filed: Jan. 31, 2002

(65) Prior Publication Data

US 2002/0101382 A1 Aug. 1, 2002

(30) Foreign Application Priority Data

Feb. 1, 2001 (JP) ..... 2001-026002

(51) Int. Cl.[7] ..... H01Q 1/38

(52) U.S. Cl. ..... 343/700 MS; 343/702; 343/873; 343/895

(58) Field of Search ..... 343/702, 700 MS, 343/895, 873

(56) References Cited

U.S. PATENT DOCUMENTS 5,760,746 A * 6/1998 Kawahata ..... 343/702
5,973,651 A * 10/1999 Suesada et al. ..... 343/752
6,064,351 A * 5/2000 Mandai et al. ..... 343/873
6,094,170 A * 7/2000 Peng ..... 343/700 MS
6,295,029 B1 * 9/2001 Chen et al. ..... 343/700 MS

FOREIGN PATENT DOCUMENTS

JP 9-55618 2/1997 ..... H01Q/7/00
JP 2000-188506 7/2000 ..... H01Q/1/24

* cited by examiner

*Primary Examiner*—Hoang V. Nguyen
(74) *Attorney, Agent, or Firm*—McGinn & Gibb, PLLC

(57) ABSTRACT

A chip antenna includes a first electrical conductor having a first end, a second electrical conductor extending in parallel with the first electrical conductor and having a second end located in alignment with the first end, a third electrical conductor extending between the first and second ends perpendicularly to the first and second electrical conductors, and a dielectric substrate. The first to third electrical conductors are integrally formed anywhere in the dielectric substrate, and power is fed to one of the first and second electrical conductors.

53 Claims, 16 Drawing Sheets

CHIP ANTENNA AND ANTENNA UNIT INCLUDING THE SAME

BACKGROUND OF THE INVENTION

1. Field of the Invention

The invention relates to a chip antenna and an antenna unit including the same, and more particularly to a mono-pole antenna having a reduced size.

Herein, a mono-pole antenna is an antenna grounded at such a portion that a dipole antenna has a maximum current amplitude at a middle, and forming electric images by grounding portions of the dipole other than the middle. A dipole antenna has a radiation pattern having polarities at opposite ends which polarities are opposite to each other, and having a peak in a direction perpendicular to the dipole antenna.

2. Description of the Related Art

Though a lot of electronic devices have been reduced in both size and weight, an antenna is not yet remarkably reduced in size. This is because that an antenna would have a high gain if it had a wide area, whereas an antenna would have a small gain if it was reduced in size, and accordingly, had a small area. If reduced in size, an antenna would have a deteriorated impedance characteristic, and in particular, would have a reduced input resistance. As a result, there is caused a problem that power fed from a communication device is reflected at an input of an antenna, and resultingly, power radiated as electromagnetic waves is reduced.

With rapid popularization of a personal computer and a cellular phone, an antenna is requested to be fabricated in a smaller size and have higher performance in order to satisfy a need of communication between perso computers or communication between personal areas through bluetooth.

As an antenna which can be reduced in size with a length thereof being kept in a certain length, there is known an antenna having a mianda line or a helical line, that is, a mianda-shaped antenna (also referred to as "meander-shaped" in the art) or a helically shaped antenna.

For instance, Japanese Unexamined Patent Publication No. 9-55618 has suggested a chip antenna having a mianda line. The suggested chip antenna is illustrated in FIG. 1.

The chip antenna 100 is comprised of a rectangular-parallelopiped substrate 101 comprised of a multi-layered dielectric layers, and an electrical conductor 104 formed on a surface 107 of the substrate 101.

The electrical conductor 104 has an end 102 through which power is fed to the chip antenna 100, and an open end 103, and has a mianda-structure having 10 corners. The electrical conductor 104 is formed on the surface 107 of the substrate 101 by printing, evaporation, adhering or plating. The mianda-shaped electrical conductor 104 extends from a first edge 101*a* to a second edge 101*b* extending in parallel with the first edge 101*a*.

The substrate 101 has a first side surface 108 and a second side surface 109 oppositely facing the first side surface 108. A power-feeding terminal 105 is formed on the first side surface 108, and a fixation terminal 106 is formed on the second side surface 109. The electrical conductor 104 is electrically connected to the power-feeding terminal 105 through the end 102, and the substrate 101 is fixed onto a circuit board (not illustrated) on which external circuits are fabricated, through the fixation terminals 106.

It is necessary to apply an intensive current to an antenna for radiating electromagnetic waves therefrom. A current is generally applied to an antenna at a power-feeding point. In addition, it is necessary for the power-feeding point to have such a length that a radiation resistance is equal to 50 ohms, in order to match the antenna to a power-feeder. The rest of the antenna other than the power-feeding point is necessary only for generating an intensive current at predetermined frequency by resonating the rest of the antenna.

From the above-mentioned standpoint, Japanese Unexamined Patent Publication No. 2000-188506 has suggested an antenna which attempts to shorten a length of the antenna by replacing the rest of the antenna other than a power-feeding point with a reactance device. The antenna suggested in the Publication is illustrated in FIG. 2.

As illustrated in FIG. 2, a linear electrical conductor pattern 112 is electrically connected at one end to a power-feeding point 113, and at the other end to a reactance device 114. The reactance device 114 is comprised of an electrical conductor having a first length in a length-wise direction which first length is longer than a second length perpendicular to the first length, such as a mianda-shaped electrical conductor. The reactance device 114 is mounted on an upper surface of a printed substrate 110 in an area where a ground pattern 111 is not formed in both upper and lower surfaces of the printed substrate 110. The reactance device 114 and the linear electrical conductor 112 extend perpendicularly to each other, and forms reverse-L-shaped configuration.

However, the above-mentioned Japanese Unexamined Patent Publication No. 9-55618 is accompanied with the following problems.

In the Publication, the chip antenna 100 is resonated by introducing electromagnetic waves into the electrical conductor 104 having a length equal to a quarter of a wavelength of the electromagnetic waves. To this end, the electrical conductor 104 has to be reciprocated many times. This results in an increase in a length of the electrical conductor 104, causing a bar in fabricating the chip antenna 100 in a small size.

In addition, the electrical conductor 104 has to be bent a lot of time in order to accommodate a longer electrical conductor 104 into a smaller space, resulting in a smaller space between adjacent electrical conductors 104. Thus, electromagnetic coupling between adjacent electrical conductors 104 is strengthened, causing an increase in both radio-frequency loss and dielectric loss in the electrical conductor 104 and a current running on a surface of the electrical conductor 104. As a result, both a radiation efficiency and a gain of the chip antenna 100 would be reduced.

Since a mono-pole antenna is located in an open space, the mono-pole antenna is likely to be electromagnetically coupled to a metal located therearound, and hence, the antenna characteristic is likely to change in dependence on surroundings. Accordingly, it is necessary for a mono-pole antenna to be designed to have a wide band width taking misregistration in mounting a mono-pole antenna into consideration.

However, since the chip antenna 100 is intended to be reduced in size by shortening a space between adjacent electrical conductors 104 in the above-mentioned Japanese Unexamined Patent Publication No. 9-55618, electromagnetic energy to be generated between electrical conductors 104 would be increased. The thus increased electromagnetic energy would cause a band width narrower, resulting in that the antenna characteristic is readily varied by surrounding metal parts existing around the chip antenna 100.

The antenna suggested in the above-mentioned Japanese Unexamined Patent Publication No. 2000-188506 is accompanied with the following problems.

The antenna includes the reactance device. However, since the reactance device is a separate part, the use of the reactance device would increase a total cost of fabricating the antenna.

In addition, it would be quite difficult to accurately analyze an operation of the antenna, if the antenna is comprised of two different parts. This may result in that the antenna would not operate in a designed manner.

SUMMARY OF THE INVENTION

In view of the above-mentioned problems in the conventional antennas, it is the first object of the present invention to provide a chip antenna and an antenna unit both of which have a wide band width though they are small in size, are hardly influenced by surrounding parts, and can be readily mounted on a substrate.

The second object of the present invention is to provide a chip antenna and an antenna unit both of which presents high radiation efficiency and high gain with a small loss.

The third object of the present invention is to provide a chip antenna and an antenna unit both of which have a simple structure, can be fabricated in the small number of steps with low costs, and can be accurately analyzed.

The fourth object of the present invention is to provide a chip antenna and an antenna unit both of which can carry out multifrequency operation with the above-mentioned merits being maintained.

In one aspect of the present invention, there is provided a chip antenna including (a) a first electrical conductor having a first end, (b) a second electrical conductor extending in parallel with the first electrical conductor and having a second end located in alignment with the first end, and (c) a third electrical conductor extending between the first and second ends perpendicularly to the first and second electrical conductors, the first to third electrical conductors being integrally formed, power being fed to one of the first and second electrical conductors.

The first to third electrical conductors arranged in the above-mentioned manner reduce electromagnetic coupling, a current running on a surface of a substrate, and distributed capacitance, and thus, accomplish low loss, a high efficiency, a high gain, and a wide band with. In addition, the first to third electrical conductors reduce electromagnetic coupling among them, and thus, are less influenced by surroundings. Furthermore, since the first to third electrical conductors are formed integral with one another, the resultant chip antenna could be fabricated in a simple structure with a low cost, and could be readily analyzed with respect to its operation.

For instance, the chip antenna may further include a dielectric substrate, the first to third electrical conductors being formed anywhere in the dielectric substrate.

As an alternative, the chip antenna may further include a circuit board on which the first to third electrical conductors are formed.

It is preferable that the chip antenna further includes at least one capacitor integrally formed in one of the first and second electrical conductors.

The capacitor would lower a resonance frequency of the chip antenna, and resultingly, would contribute to reduction in a size of the chip antenna.

A plurality of capacitors would provide a plurality of resonance frequencies.

The first to third electrical conductors and the capacitor may be formed on a surface of the dielectric substrate, on a surface of a later mentioned circuit board, or inside the dielectric substrate.

For instance, the capacitor may be comprised of at least one first extension extending from the first electrical conductor to the second electrical conductor and at least one second extension extending from the second electrical conductor to first second electrical conductor such that the first and second extensions are in alignment with each other.

As an alternative, the capacitor may be comprised of at least one extension extending from one of the first and second electrical conductors to the other.

As an alternative, the capacitor may further include at least one capacitor which extends perpendicularly to the first to third electrical conductors in a thickness-wise direction of the dielectric substrate.

The capacitor extending perpendicularly to the first to third electrical conductors in a thickness-wise direction of the dielectric substrate could shorten a length of the first and second electrical conductors.

It is preferable that the chip antenna further includes at least one mianda line having an open end and extending from one of the first and second electrical conductors to the other.

The mianda line would provide the chip antenna with a high inductance.

It is preferable that the chip antenna further includes a capacitive plate defining a capacitance between the capacitive plate and a ground.

It is preferable that the chip antenna further includes a capacitive plate defining a capacitance between the capacitive plate and a ground, the capacitive plate being formed on a surface of the dielectric substrate on which the first to third electrical conductors are formed.

It is preferable that the chip antenna further includes a capacitive plate defining a capacitance between the capacitive plate and a ground and electrically connected to one of the first and second electrical conductors, in which case, the capacitive plate may be formed on a surface of the dielectric substrate other than a surface of the dielectric substrate on which the first to third electrical conductors are formed.

For instance, the first to third electrical conductors may be formed on a surface of the dielectric substrate or on a surface of the circuit board by printing.

The dielectric substrate may be designed to have a multilayered structure, in which case, the first to third electrical conductors may be printed onto the dielectric substrate.

For instance, the dielectric substrate may be a rectangular-parallelopiped, a cubic, a cylinder, or a polygonal pole in shape.

For instance, the first and second electrical conductors are formed in a line or in a curve.

It is preferable that the first and second electrical conductors have a length equal to or smaller than a quarter of a wavelength of electromagnetic wave emitted from the chip antenna.

It is preferable that the first and second electrical conductors are thinner than the third electrical conductor.

There is further provided a chip antenna including (a) a first electrical conductor having a first end, (b) a second electrical conductor extending in parallel with the first electrical conductor and having a second end located in alignment with the first end, (c) a third electrical conductor extending between the first and second ends perpendicularly to the first and second electrical conductors, and (d) a power-feeding line electrically connected to one of the first and second electrical conductors and extending in parallel with the third electrical conductor, the first to third electrical conductors and the power-feeding line being integrally formed, power being fed to one of the first and second electrical conductors through the power-feeding line.

The first to third electrical conductors arranged in the above-mentioned manner reduce electromagnetic coupling, a current running on a surface of a substrate, and distributed capacitance, and thus, accomplish low loss, a high efficiency, a high gain, and a wide band with. In addition, the first to third electrical conductors reduce electromagnetic coupling among them, and thus, are less influenced by surroundings. Furthermore, since the first to third electrical conductors are formed integral with one another, the resultant chip antenna could be fabricated in a simple structure with a low cost, and could be readily analyzed with respect to its operation.

The power-feeding line may be formed on a surface of a dielectric substrate, for instance, on which the first to third electrical conductors are also formed. The power-feeding line may be formed on a surface of a circuit board, for instance, together with a capacitor. As an alternative, the first to third electrical conductors and the capacitor may be formed on a surface of or inside a dielectric substrate, and the power-feeding line may be formed on a circuit board.

In another aspect of the present invention, there is provided an antenna unit including (a) one of the above-mentioned chip antennas, and (b) a circuit board having a ground area and a non-ground area on a surface thereof, wherein the chip antenna is mounted on a surface of the circuit board such that a power-feeding line of the chip antenna is located in the non-ground area and the ground area acts as a ground plate by which the chip antenna is grounded.

The advantages obtained by the aforementioned present invention will be described hereinbelow.

The first advantage is as follows.

Since the chip antenna in accordance with the present invention includes the first to third electrical conductors configured in the above-mentioned manner, in place of a mianda line which ensures a length necessary for causing resonance, there can be obtained a high impedance between the electrical conductors, resulting in reduction in electromagnetic coupling among the electrical conductors, a current running on a surface of a substrate such as a dielectric substrate, and a distributed capacitance. Hence, the chip antenna and the antenna unit in accordance with the present invention ensure low loss, a high efficiency, a high gain, and a wide band width.

The second advantage is as follows.

The first to third electrical conductors configured in the above-mentioned manner can weaken electromagnetic coupling among them, and hence, ensure a small-sized chip antenna and antenna unit which are less influenced by surroundings.

The third advantage is as follows.

Since the first to third electrical conductors configured in the above-mentioned manner are formed integral with one another, the resultant chip antenna and antenna unit would be fabricated in a simple structure in the small number of fabrication steps with low costs, and could be accurately and readily analyzed with respect to its operation.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIG. 6C is a circuit diagram of an equivalent circuit equivalent to the chip antenna included in the antenna unit illustrated in FIG. 6A.

DESCRIPTION OF THE PREFERRED EMBODIMENTS

Preferred embodiments in accordance with the present invention will be explained hereinbelow with reference to drawings.

In the embodiments mentioned hereinbelow, all chip antennas and antenna units stand vertically. However, it should be noted that they may be used in such a manner that they lie horizontally.

[First Embodiment]

Figure 1:
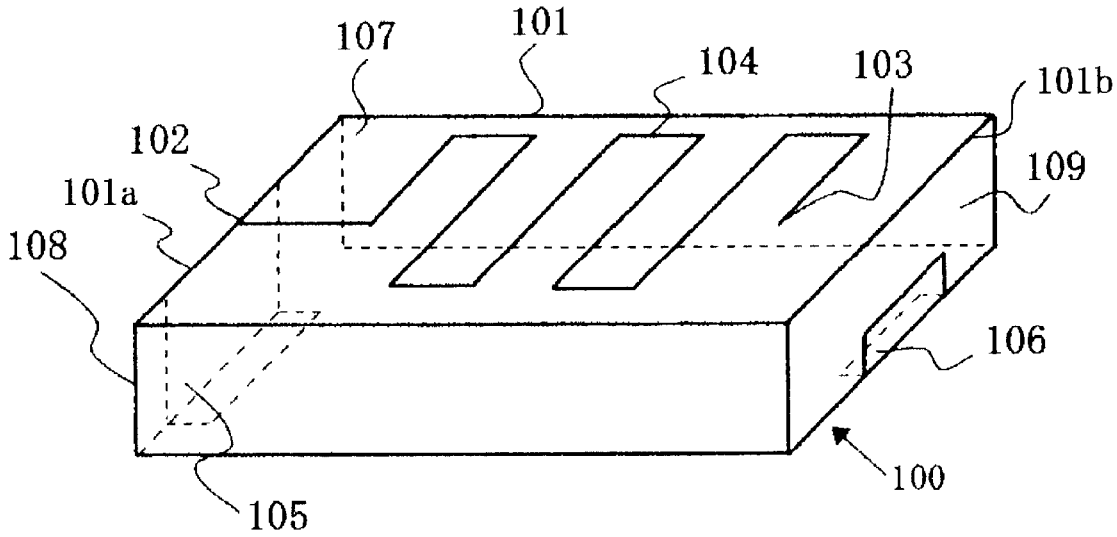
FIG.1 PRIOR ART
FIG. 1 is a perspective view of a conventional chip antenna.
Figure 2:
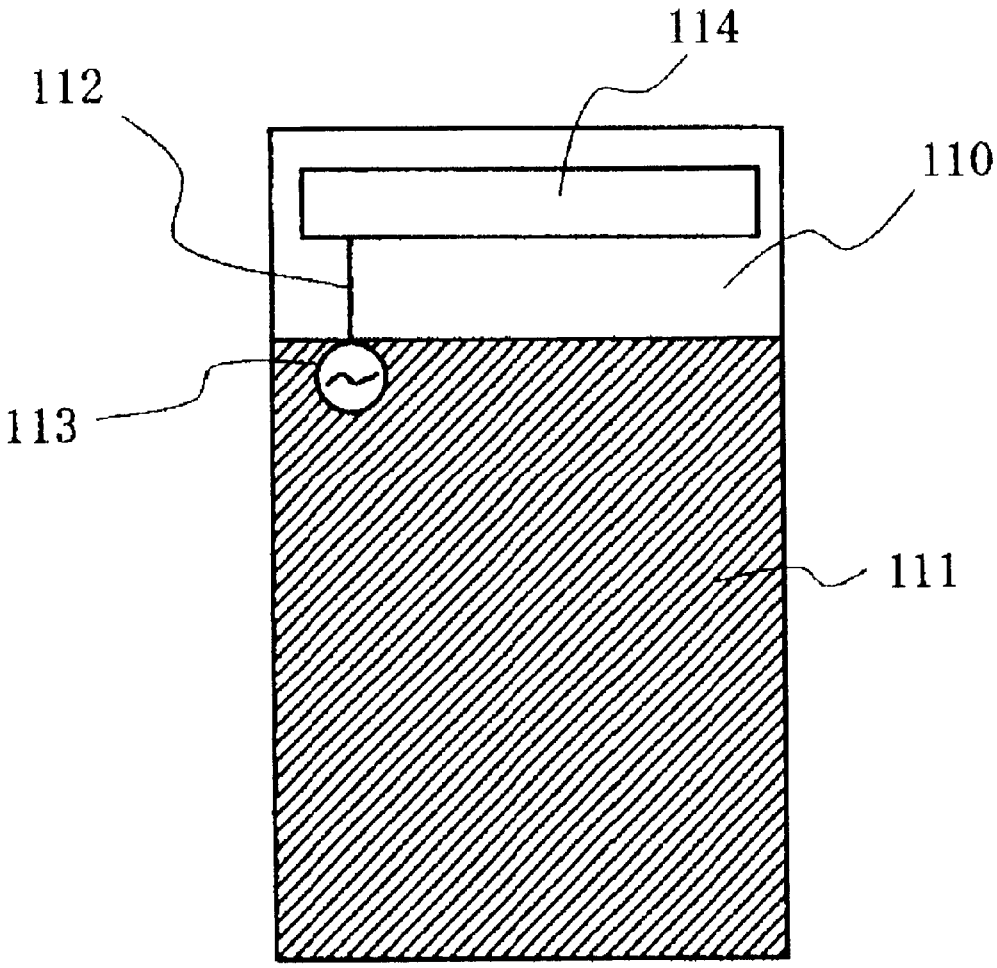
FIG.2 PRIOR ART
FIG. 2 is a plan view of another conventional chip antenna.
Figure 3A:
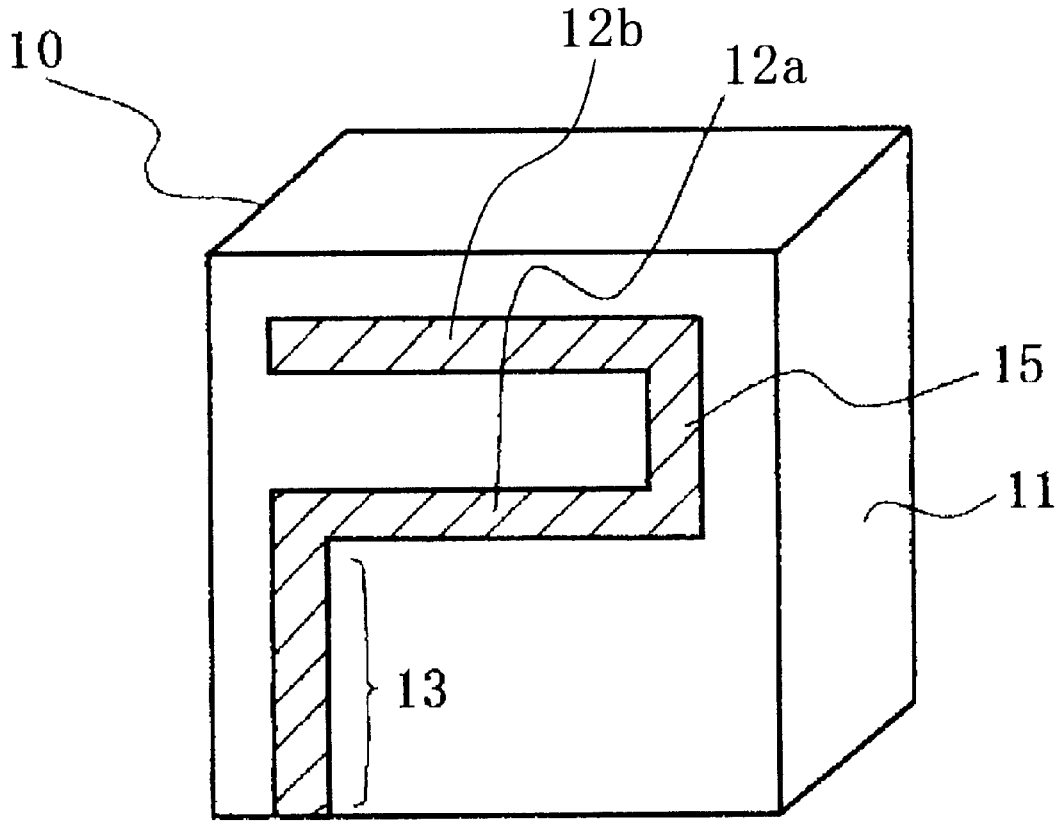
FIG. 3A is a perspective view of the chip antenna in accordance with the first embodiment of the present invention.

FIG. 3A is a perspective view of the chip antenna in accordance with the first embodiment.

The chip antenna 10 in accordance with the first embodiment is comprised of a rectangular-parallelopiped dielectric substrate 11 composed of ceramic, a first electrical conductor 12*a* having a first end, a second electrical conductor 12*b* extending in parallel with the first electrical conductor 12*a* and having a second end located in alignment with the first end, a third electrical conductor 15 extending between the first end of the first electrical conductor 12*a* and the second end of the second electrical conductor 12*b* perpendicularly to the first and second electrical conductors 12*a* and 12*b,* and a power-feeding line 13 electrically connected to the second electrical conductors 12*b* at the other end thereof, and extending in parallel with the third electrical conductor 15.

Power is fed to the first and second electrical conductors 12*a* and 12*b* through the power-feeding line 13.

Since the third electrical conductor 15 acts also as an antenna, the third electrical conductor 15 is designed to extend in parallel with the power-feeding line 13.

The first to third electrical conductors 12*a,* 12*b* and 15 and the power-feeding line 13 are integrally formed on a surface of the dielectric substrate 11 by printing them onto the surface. However, it should be noted that the first to third electrical conductors 12*a,* 12*b* and 15 and the power-feeding line 13 may be printed inside the dielectric substrate 11, or may be formed on a surface of or inside the dielectric substrate 11 by any processes other than printing.

The first and second electrical conductors 12*a* and 12*b* are formed always perpendicularly to the power-feeding line 13, regardless of a process by which the first and second electrical conductors 12*a* and 12*b* and the power-feeding line 13 are formed.

It is not always necessary for the first and second electrical conductors 12*a* and 12*b* to be formed in a line. They may be formed in a curve, if a space between them is kept constant. By forming the first and second electrical conductors 12*a* and 12*b* in a curve, it would be possible to lengthen the first and second electrical conductors 12*a* and 12*b* in a limited space, ensuring that a charge inductance is increased, and accordingly, the chip antenna can be fabricated in a small size.

Figure 3B:
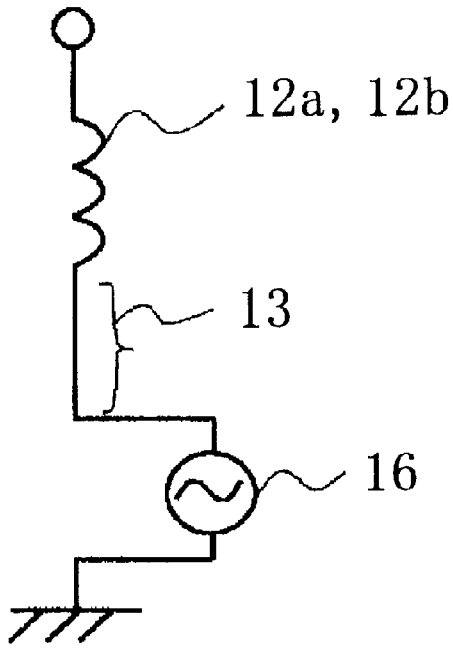
FIG. 3B is a circuit diagram of an equivalent circuit equivalent to the chip antenna illustrated in FIG. 3A.

When the chip antenna 10 is used as a mono-pole antenna, the dielectric substrate 11 is laid on a metal plate (not illustrated), and, a power-feeder 16 is arranged between the dielectric substrate 11 and the metal plate, as illustrated in FIG. 3B. In addition, the power-feeding line 13 is designed to be vertical to the metal plate in the vicinity of the power-feeder 16. By resonating a current amplitude supplied from the power-feeder 16 such that the current amplitude is maximized in the vicinity of the power-feeder 16, an intensive current runs across the power-feeder 16, and resultingly, electromagnetic waves having a resonance frequency are radiated to atmosphere.

Assuming that a width of the first and second electrical conductors 12*a* and 12*b* is ignored, an impedance Z(L) of the first and second electrical conductors 12*a* and 12*b* to be measured from the open ends of the first and second electrical conductors 12*a* and 12*b* electrically connected at the other ends to each other is defined in accordance with the following equation:

$$Z(L)=jZ0\times\tan(2\pi L/\lambda) \quad \text{(A)}$$

wherein L indicates a length of the first and second electrical conductors 12*a* and 12*b* from open ends thereof to the third electrical conductor 13, λ indicates a wavelength of electromagnetic waves, and Z0 indicates a characteristic impedance of the first and second electrical conductors 12*a* and 12*b*.

Hence, if the first and second electrical conductors 12*a* and 12*b* had a length equal to or smaller than λ/4. they act as an inductor having an inductance in the range of 0 to infinity (□).

FIG. 3B is a circuit diagram of an equivalent circuit equivalent to the chip antenna 10 further including the power feeder 16 and wherein the first and second electrical conductors 12*a* and 12*b* have a length equal to or smaller than λ/4. In FIG. 3B, reciprocal inductances of the first and second electrical conductors 12*a* and 12*b* is shown as a single inductance.

When electromagnetic waves are to be radiated from the power-feeding line 13 in a mono-pole antenna, a current I supplied to the power-feeding line 13 from the power-feeder 16 is set to be maximum in the vicinity of the power-feeder 16 in dependence on a distance from the power-feeder 16 to the mono-pole antenna, that is, a height of the chip antenna 10. Such a current I is produced by varying both a length of the power-feeding line 13 and the impedance Z(L) such that the current I is resonated at a frequency of electromagnetic waves to be radiated from the power-feeding line 13. Specifically, a length of the power-feeding line 13 and the impedance Z(L) are determined such that a reactance of the input impedance Z(L) is nearly equal to zero when viewed from the power-feeder 16.

The above-mentioned equation (A) merely defines an approximate impedance Z(L). An accurate impedance Z(L) is determined by adjusting a width of the first and second electrical conductors 12*a* and 12*b,* a gap between the first and second electrical conductors 12*a* and 12*b,* and the characteristic impedance Z0.

Electromagnetic waves to be radiated from the power-feeding line 13 could have a wider band width, if the first and second electrical conductors 12*a* and 12*b* were thinner and the third electric conductor 13 were thicker.

Figure 3C:
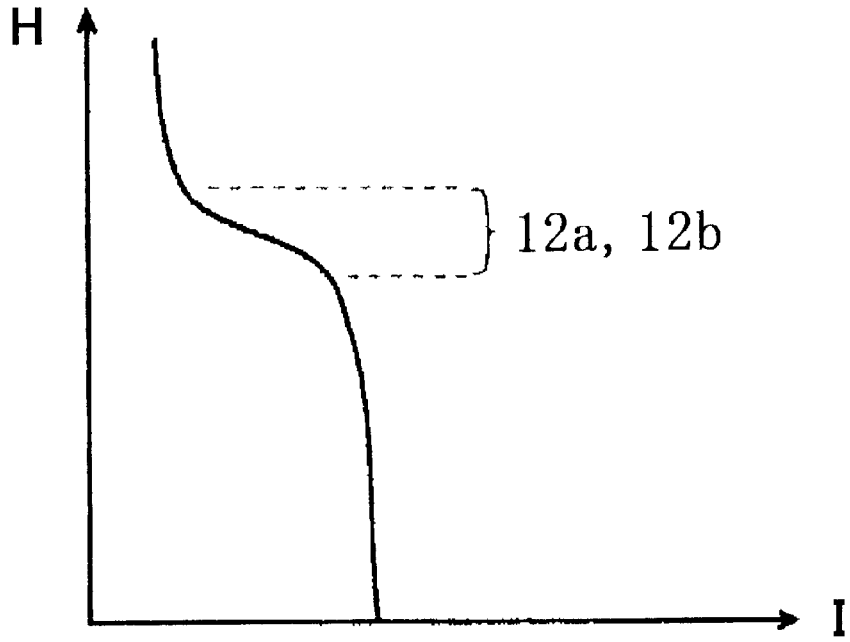
FIG. 3C is a graph showing a relation between a height of the chip antenna illustrated in FIG. 3A and a current to be applied to the chip antenna.

As is obvious in view of FIG. 3C, the current I becomes smaller at a location remoter from the power-feeder 16, and finally, does not contribute to radiation. In an area where the power-feeder line 13 is not necessary to exist, the first and second electrical conductors 12*a* and 12*b* are charged in place of the power-feeding line 13. Even though the power-feeding line 13 is partially. replaced with the first and second electrical conductors 12*a* and 12*b* as mentioned above, it would be possible to make the power-feeding line 13 seem to have a sufficient length, when viewed from the power-feeder 16, by varying a length of the power-feeding line 13 and the impedance Z(L). As a result, it is possible to shorten the power-feeding line 13.

Since electromagnetic coupling between electrical conductors in the first and second electrical conductors 12*a* and 12*b* is less than the same in a mianda antenna or a helical antenna, less current runs on surfaces of the first and second electrical conductors 12*a* and 12*b*. and a loss in the first and second electrical conductors 12*a* and 12*b* is reduced, ensuring enhancement in a radiation efficiency. In addition, an inductance is slowly produced in the first and second electrical conductors 12*a* and 12*b,* and hence, less current runs on surfaces of them, a loss is reduced, ensuring enhancement in a radiation efficiency. Furthermore, since the first and second electrical conductors 12*a* and 12*b* and the third electrical conductor 13 are composed of a common material, it would be possible to analyze and readily fabricate the chip antenna 10.

Hereinbelow is explained how a size of the chip antenna 10 is determined.

It is necessary not only to make a reactance of the input impedance nearly equal to zero when viewed from the power-feeder 16, as mentioned earlier, but also to equalize a resistance in the input impedance to a characteristic impedance of 50 ohms in a coaxial cable through which power is fed to the power-feeding line 13 from the power feeder 16, in order to match the chip antenna 10 to the power-feeder 16, and minimize a power reflected from the chip antenna 10. From this standpoint, it is preferable that a line between the power feeder 16 and the power-feeding line 13 is comprised of a transmission line such as a coaxial cable.

A resistance of an input to the chip antenna 10 is equal to a power loss in the chip antenna 10, that is, an equivalence of a sum of a thermal loss and a radiation loss into a resistance. Herein, the thermal loss consists of a loss in the electrical conductors and a loss in the dielectric substrate, and the radiation loss is equal to a power loss caused by radiation of electromagnetic waves. A resistance equivalent to the thermal loss is in proportion to a length of the power-feeding line 13. A resistance equivalent to the radiation loss is known to be in proportion to a square of X/Y according to the theory of a linear antenna, wherein X indicates a length of a power-feeding line, and Y indicates a wavelength of radiated electromagnetic waves. Thus, a resistance equivalent to the radiation loss can be used as an indication of radiation ability of an antenna.

Electromagnetic waves radiated from the power-feeding line 13 have a wavelength which is dependent on parameters such as a thickness of the dielectric substrate 11, a dielectric constant of the dielectric substrate 11, and whether the first to third electrical conductors 12*a,* 12*b* and 13 are printed on a surface of or inside the dielectric substrate 11. Thus, a length of the power-feeding line 13 is determined in dependence on not only the earlier mentioned method of determining the input resistance, but also above-mentioned parameters. That is, a length of the power-feeding line 13 is determined such that a resistance of the input impedance is equal to 50 ohms.

If the first and second electrical conductors 12*a* and 12*b* do not radiate electromagnetic waves, and the third electrical conductor 13 has a length short enough to be able to ignore relative to a length of the power-feeding line 13, it would not be necessary to consider the first to third electrical conductors 12*a,* 12*b* and 15 for determining the input resistance to be measured viewing from the power-feeder 16.

An imaginary number of the input impedance in the chip antenna 10 is determined such that resonance occurs in a quarter wavelength mono-pole antenna when the imaginary number is nearly equal to zero, and that resonance occurs at a certain frequency by adjusting a length of the first to third electrical conductors 12*a,* 12*b* and 15, a gap between the first and second electrical conductors 12*a* and 12*b,* and a width of the first and second electrical conductors 12*a* and 12*b*. In actual, intensive resonance occurs when an imaginary number of the input impedance is slightly positively deviated from zero. This is because, when an imaginary number is slightly positively deviated from zero, a current amplitude in the power-feeder line 13 is maximized, and resultingly, the radiation resistance becomes closer to 50 ohms, that is, the radiation resistance approaches the above-mentioned matching conditions.

A characteristic impedance Z0 in the first and second electrical conductors 12*a* and 12*b* is defined as follows.

$$Z0=1/(\pi\eta)\times \mathrm{Ln}\ (4D/W) \qquad \text{(B)}$$

Herein, $1/\eta$ is equal to sqrt ($\mu/\in$), which is equal to 377 sqrt ($\mu s/\in$) ($1/\eta$=sqrt ($\mu/\in$)=377 sqrt ($\mu s/\in s$)), wherein $\mu$ indicates a magnetic-field-permeability ratio of a material existing around the first and second electrical conductors 12*a* and 12*b*, $\in$ indicates a dielectric constant of the material, $\mu s$ indicates a specific magnetic-field-permeability ratio of the material, $\in s$ indicates a specific dielectric constant, D indicates a gap between centers of the first and second electrical conductors 12*a* and 12*b,* and W indicates a width of the first and second electrical conductors 12*a*and 12*b*. It is assumed that D is significantly greater than W (D>>W).

Herein, a specific dielectric constant $\in s$ means an effective specific dielectric constant defined by a dielectric constant of a material existing around the first and second electrical conductors 12*a* and 12*b*. For instance, a specific dielectric constant $\in s$ is equal to an average of a dielectric constant of the dielectric substrate 11 and a dielectric constant of air in the first and second electrical conductors 12*a* and 12*b* printed onto a surface of the dielectric substrate 11. Accordingly, since the effective specific dielectric constant in the above-mentioned example is smaller than a specific dielectric constant of the dielectric substrate 11, a wavelength of electromagnetic waves is less shortened than a chip antenna in which the first and second electrical conductors 12*a* and 12*b* are formed inside the dielectric substrate 11.

In accordance with the equation (B), higher a dielectric constant $\in s$ is, smaller a gap D between centers of the first and second electrical conductors 12*a* and 12*b* is, or greater a width W of the first and second electrical conductors 12*a* and 12*b* is, lower the characteristic impedance Z0 is. In contrast, smaller a dielectric constant $\in s$ is, greater a gap D between centers of the first and second electrical conductors 12*a* and 12*b* is, or smaller a width W of the first and second electrical conductors 12*a* and 12*b* is, higher the characteristic impedance Z0 is. A higher characteristic impedance Z0 means smaller electromagnetic coupling between the first and second electrical conductors 12*a* and 12*b,* and resultingly, a current running on a surface of the first and second electrical conductors 12*a* and 12*b* is reduced, a loss in the first to third electrical conductors 12*a*, 12*b* and 15 is reduced, a radiation efficiency is increased, and a band width is widened.

In view of the above-mentioned matters, a charged inductance of the chip antenna 10 is adjusted by varying a length of the first and second electrical conductors 12*a* and 12*b*, a width of the first and second electrical conductors 12*a* and 12*b*, and a gap between the first and second electrical conductors 12*a* and 12*b*, to thereby cause the chip antenna 10 to be resonated at a predetermined frequency.

Though a conventional antenna is resonated by means of electrical conductors having a length designed as long as possible, such as a mianda line, the chip antenna 10 in accordance with the first embodiment is based on the concept that the chip antenna 10 is resonated by means of the power-feeding line 13 having a length shortened by charging a reactance thereto. In addition, in the chip antenna 10 in accordance with the first embodiment, the characteristic impedance in the first and second electrical conductors 12*a* and 12*b* is set as high as possible to thereby weaken electromagnetic coupling between the first and second electrical conductors 12*a* and 12*b,* ensuring improvement in radio-frequency characteristic of the chip antenna 10.

[Second Embodiment]

In the chip antenna 10 in accordance with the above-mentioned first embodiment, the first and second electrical conductors 12*a* and 12*b* are electromagnetically coupled to each other in a radio-frequency electromagnetic field, and resultingly, a high short-circuit current runs through the third electrical conductor 15. In the first embodiment, since the third electrical conductor 15 is relatively short in length, an operation of the third electrical conductor 15 as an antenna was ignored.

In contrast, the third electrical conductor in the second embodiment is formed longer than the third electrical conductor 15 in the first embodiment for the purpose of making use of a short-circuit current running through the third electrical conductor, in an operation of an antenna. In addition, by forming the third electrical conductor longer, a gap between the first and second electrical conductors is also increased, resulting in that a characteristic impedance in the first and second electrical conductors is increased, the first and second electrical conductors are electromagnetically coupled to each other in a less degree than the first embodiment, and hence, the chip antenna could have an improved radio-frequency characteristic.

Figure 4:
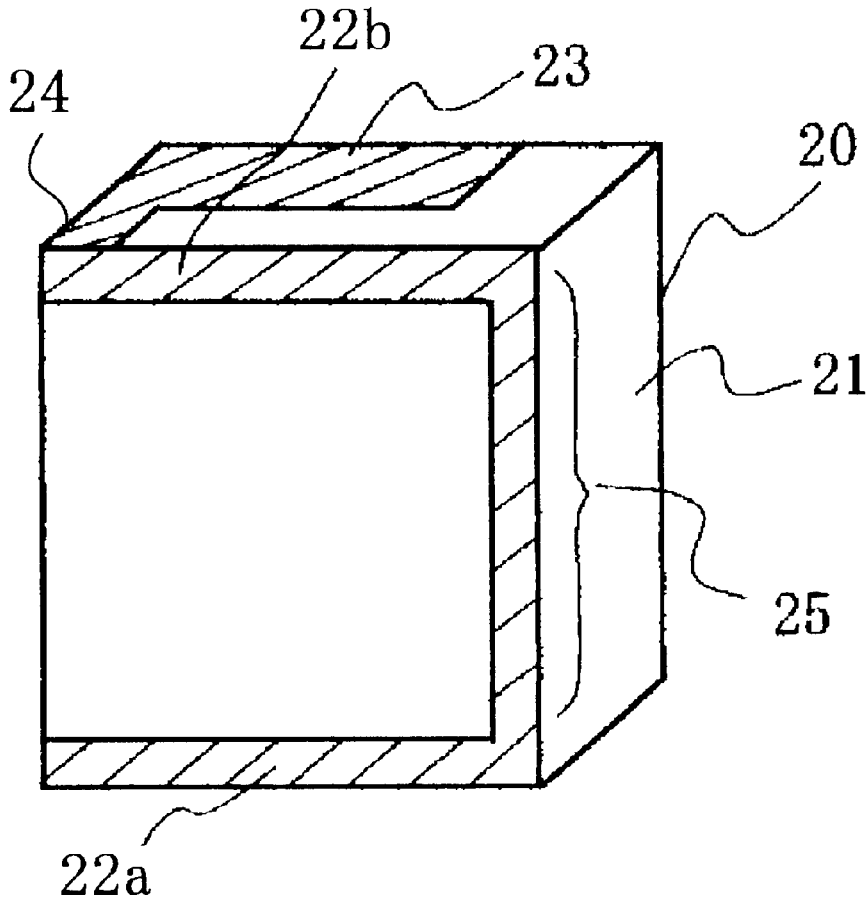
FIG. 4 is a perspective view of the chip antenna in accordance with the second embodiment of the present invention.

FIG. 4 illustrates the chip antenna 20 in accordance with the second embodiment of the present invention.

The chip antenna 20 is comprised of a rectangular-parallelopiped dielectric substrate 21, a first electrical conductor 22*a* printed onto a front surface of the dielectric substrate 21 so that the first electrical conductor 22*a* extends along a lower edge of the front surface of the dielectric substrate 21, a second electrical conductor 22*b* printed onto the front surface of the dielectric substrate 21 so that the second electrical conductor 22*b* extends along an upper edge of the front surface of the dielectric substrate 21, a third electrical conductor 25 printed onto the front surface of the dielectric substrate 21 so that the third electrical conductor 25 extends along a right edge of the front surface of the dielectric substrate 21 to thereby electrically connect the first and second electrical conductors 22*a* and 22*b* to each other at their right ends, and a capacitive plate 23 printed onto an upper surface of the dielectric substrate 21.

The upper surface on which the third electrical conductor 15 is printed is perpendicular to the front surface on which the first and second electrical conductors 22*a* and 22*b* are printed. The third electrical conductor 25 is formed sufficiently longer than the third electrical conductor 15 in the first embodiment.

The second electrical conductor 22*b* is electrically connected at its open end to the capacitive plate 23 through a connecting line 24 extending on the upper surface along a left edge of the upper surface. The capacitive plate 23 has a width greater than a width of the first to third electrical conductors 22*a*, 22*b* and 25 and the connecting line 24, and is composed of the same material as a material of which the first to third electrical conductors 22*a*, 22*b* and 25 and the connecting line 24 are composed. The capacitive plate 23 extends in a direction perpendicular to a length-wise direction of the connecting line 24.

The first to third electrical conductors 22*a*, 22*b* and 25 and the capacitive plate 23 may be printed inside the dielectric substrate 21, or may be formed on a surface of or inside the dielectric substrate 21 by any process other than printing.

Figure 5:
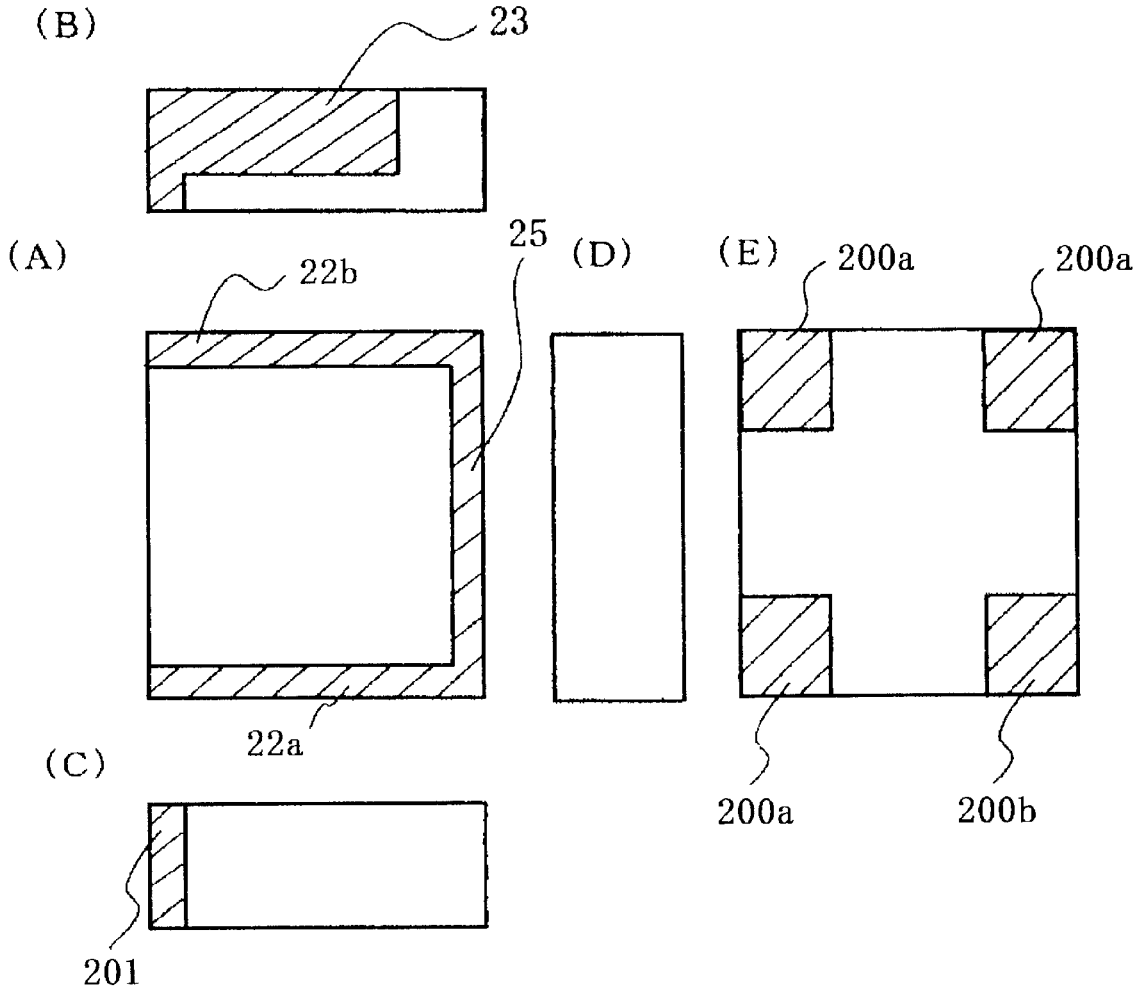
FIG. 5 is a development view of the chip antenna illustrated in FIG. 4.
Figure 6A:
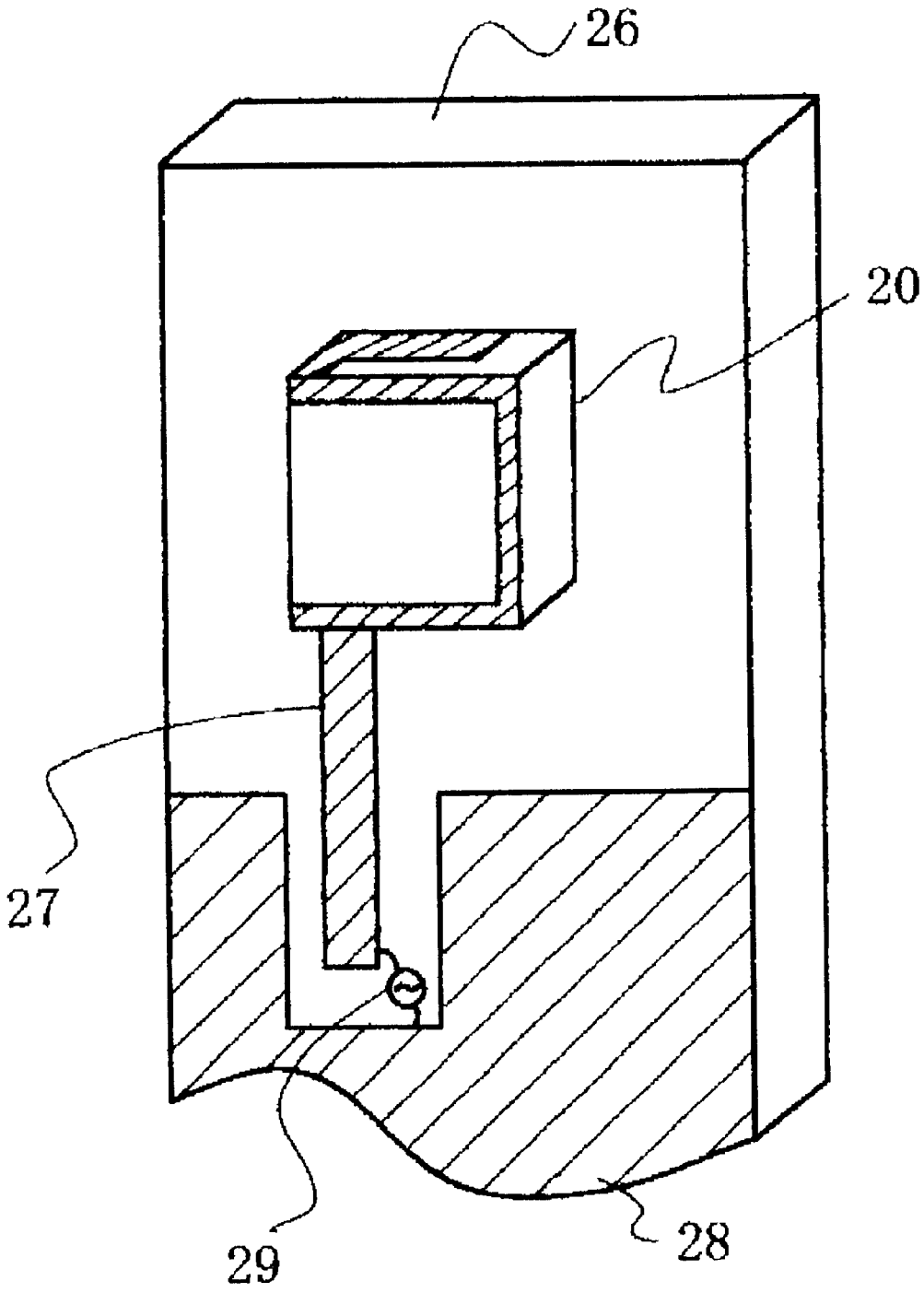
FIG. 6A is a perspective view of the antenna unit including the chip antenna illustrated in FIG. 4.
Figure 6B:
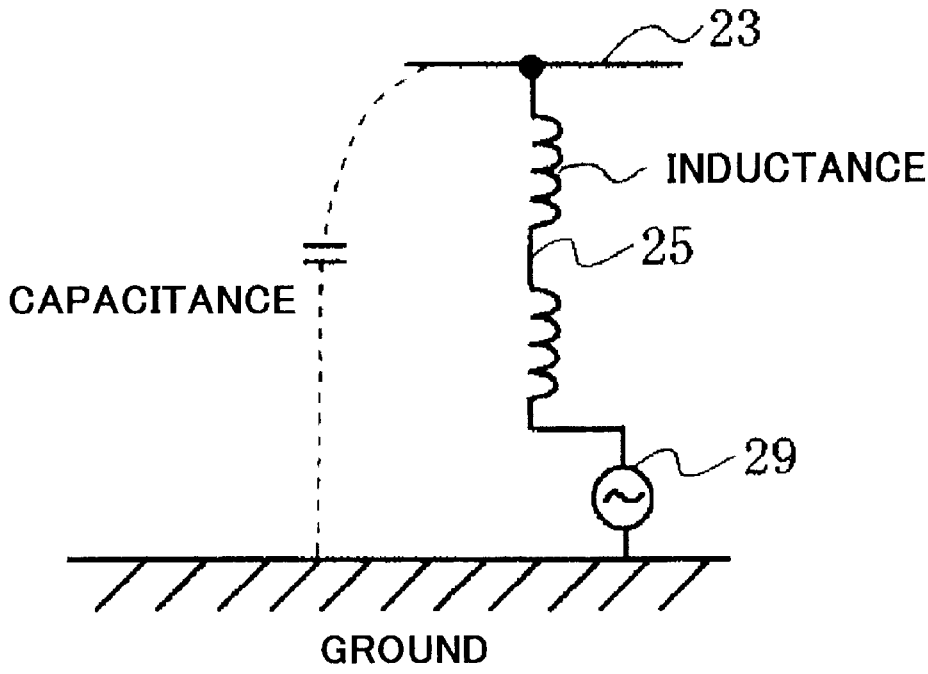
FIG. 6C is a circuit diagram of an equivalent circuit equivalent to the antenna unit illustrated in FIG. 6A.
Figure 6C:
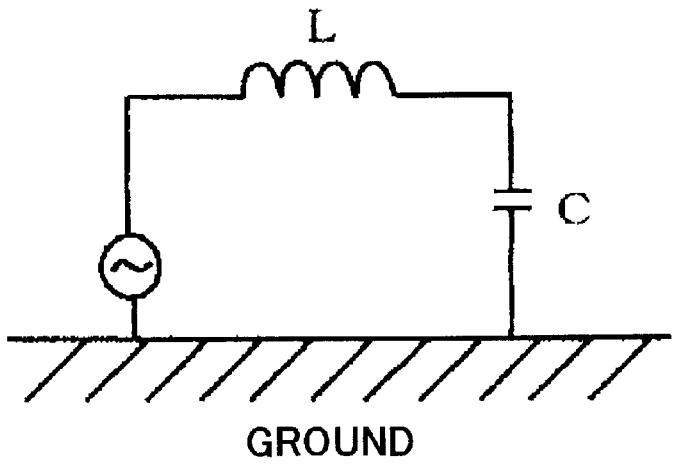
Figure 7:
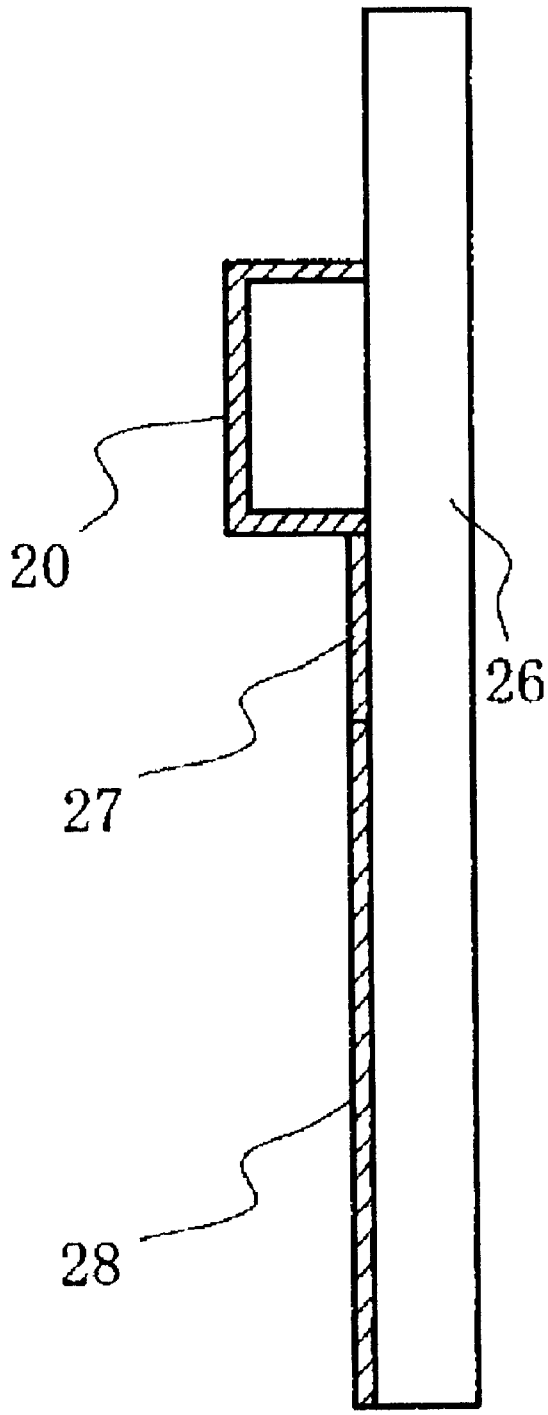
FIG. 7 is a side view of the antenna unit illustrated in FIG. 6A.

FIG. 5 is a development view of the chip antenna 20 illustrated in FIG. 4. In FIG. 5, (A) is a front view, (B) is an upper plan view, (C) is a bottom view, (D) is a left and right side view, and (E) is a rear view. FIG. 6A is a perspective view of an antenna unit comprised of a circuit board 26, and the chip antenna 20 mounted on the circuit board 26, FIG. 6B is a circuit diagram of an equivalent circuit equivalent to the antenna unit illustrated in FIG. 6A, and FIG. 6C is a circuit diagram of an equivalent circuit equivalent to the chip antenna 20. FIG. 7 is a side view of the antenna unit illustrated in FIG. 6A.

The circuit board 26 is composed of glass epoxy resin. A power-feeding line 27 electrically connected to the chip antenna 20 and a ground electrode 28 defining a wide land are formed on a surface of the circuit board 26 by printing. The ground electrode 28 is partially removed around the power-feeding line 27 such that the ground electrode 28 surrounds the power-feeding line 27. A power-feeder 29 is electrically connected across the power-feeding line 27 and the ground electrode 28. The power-feeder 29 supplies power to the chip antenna 20 through a coaxial cable. The power-feeding line 27 forms a coplanar line beyond a power-feeding point.

As illustrated in FIG. 5(C), a power-feeding line 201 is formed on a bottom surface of the dielectric substrate 21, extending along a left edge of the bottom surface, that is, in a thickness-wise direction of the dielectric substrate 21. The power-feeding line 201 is electrically connected at one end thereof to the first electrical conductor 22*a* at its open end.

As illustrated in FIG. 5(E), the dielectric substrate 204 is formed at three corners of its rear surface with three fixation electrodes 200*a*. The dielectric substrate 21 is fixed onto the circuit board 26 by soldering the fixation electrodes 200*a* to the circuit board 26.

As illustrated in FIG. 5(E), the dielectric substrate 204 is further formed at the rest of corners of its rear surface with an excitation electrode 200*b* electrically connecting to the power-feeding line 201 formed on the bottom surface of the dielectric substrate 201. The dielectric substrate 201 is soldered to the power-feeding line 27 through the excitation electrode 200*b*.

Thus, the power-feeder 29 supplies power to the chip antenna 20 through the power-feeding line 27, the excitation electrode 200*b*, and the power-feeding line 201 in sequence.

Since the power-feeding line 27 is printed on the circuit board 26 having a lower dielectric constant than that of the dielectric substrate 21, the power-feeding line 27 functions as an antenna less aggressively than the third electrical conductor 25, and mainly functions as a medium through which power is supplied. Hence, the power-feeding line 27 may be replaced with a coaxial cable extending from the power-feeder 29, in place of printing the power-feeding line 27 onto a surface of the circuit board 26.

A size of the first and second electrical conductors 22*a* and 22*b* is determined in the same manner as the above-mentioned first embodiment. Specifically, the third electrical conductor 25 associated with a real number in the input impedance of the chip antenna 20 corresponds to the power-feeding line 13, and the first and second electrical conductors 22*a* and 22*b* associated with an imaginary number in the input impedance of the chip antenna 20 correspond to the first and second electrical conductors 12*a* and 12*b*.

A specific example is described hereinbelow.

The dielectric substrate 21 is composed of ceramics having a dielectric constant of 21, and has a height of 6 mm, a width of 4 mm, and a thickness of 1.5 mm. The power-feeding line 27 has a width of 1 mm. The first and second electrical conductors 22*a* and 22*b* have a width of 0.4 mm. The third electrical conductor 25 has a width of 0.5 mm. A gag between the dielectric substrate 21 and the ground electrode 28 is 4 mm. The ground electrode 28 has an area of 10 mm×30 mm, and a thickness of 0.2 mm.

The inventors simulated the chip antenna 20 having the above-mentioned dimensions, and had the following results.

Resonance frequency: 2.4 GHz

Radiation efficiency: 95%

Band width: 450 MHz

To compare with the above-mentioned chip antenna 20, the inventors had fabricated the reference chip antenna comprised of mianda lines and having the same dimensions as the above-mentioned dimensions except that a width of the electrical conductors was 0.5 mm and a gap between the electrical conductors was 0.5 mm. The chip antenna 20 is smaller than the reference chip antenna with respect to a current running on a surface of the electrical conductors. According to the simulation carried out by the inventors, the thermal loss joule loss) in the chip antenna 20 was half of the thermal loss in the reference chip antenna. The reference chip antenna had a radiation efficiency of 93% and a band width of 300 MHz.

The reason of the above-mentioned results is considered as follows.

Whereas it is necessary in a mianda line to arrange electrical conductors on a dielectric substrate in a high density in order to increase a length of the electrical conductors, a gap between the first and second electrical conductors 22*a* and 22*b* is designed to be great for ensuring an inductance in the second embodiment. Accordingly, the first and second electrical conductors 22*a* and 22*b* in the chip antenna 20 in accordance with the second embodiment are less electromagnetically coupled to each other than the electrical conductors in the reference chip antenna, resulting in that the chip antenna 20 would have a smaller distributed capacitance, a smaller current running on a surface of the electrical conductors, and a smaller electric field in the dielectric substrate in the vicinity of the electrical conductors than the reference chip antenna.

In addition, since an antenna does not have a function of amplification, smaller a loss is and higher an efficiency is, higher a gain is.

As mentioned above, the first and second electrical conductors 22*a* and 22*b* are less electromagnetically coupled with metal than the electrical conductors in the reference chip antenna, and accordingly, the chip antenna 20 can provide a higher gain, a higher efficiency and a wider band width than the reference chip antenna.

The inventors had fabricated the following chip antennas A to C, and analyzed them in order to examine how the chip antenna 20 was influenced by conditions for mounting the chip antenna 20 on the circuit board 26.

A: a chip antenna in which the ground electrode 28 has a thickness of 2 mm

B: a chip antenna in which the ground electrode 28 has a thickness of 0.02 mm and is formed shorter in a length-wise direction thereof than the ground electrode 28 of the chip antenna 20

C: a chip antenna in which the ground electrode 28 extends at a side of the chip antenna so that the extended ground electrode is located adjacent to the chip antenna side by side.

It was found out that the first and second electrical conductors 22*a* and 22*b* exerted less influence on an antenna efficiency than the mianda line in each of the above-mentioned chip antennas A to C.

In a mianda line in which electrical conductors are arranged at a high density, electromagnetic fields caused by electrical conductors are coupled to each other also at a high density, and hence, the chip antenna is likely to be influenced by the ground electrode. In contrast, the chip antenna 20 in accordance with the second embodiment has a sufficient gap between the first and second electrical conductors 22*a* and 22*b*, and hence, the chip antenna 20 is less influenced by conditions for mounting the chip antenna 20 on the circuit board 26, including a thickness and/or an area of the ground electrode 28.

As illustrated in FIGS. 4, 5 and 6A, the chip antenna 20 is formed at an upper surface thereof with the capacitive plate 23. As illustrated in FIG. 6B, the capacitive plate 23 defines a high capacitance C between an open end of the second electrical conductor 22*b* and the ground electrode 28. The two inductances illustrated in FIG. 6B are caused by the first and second electrical conductors 22*a* and 22*b* coupled to each other through the third electrical conductor 25. Accordingly, an equivalent circuit equivalent to the chip antenna 20 makes a LC series circuit illustrated in FIG. 6C which has a resonance frequency of $1/(2\pi\times(LC)^{1/2})$. Thus, the capacitance C lowers a resonance frequency of the chip antenna 20, and resultingly, the capacitive plate 23 would make it possible to fabricate the chip antenna 20 in a smaller size.

[Third Embodiment]

The chip antenna in accordance with the third embodiment receives a plurality of resonance frequencies, and radiate electromagnetic waves having a plurality of frequencies. Multi-frequency operation for receiving a plurality of resonance frequencies can be accomplished by means of a parallel resonance circuit or a series resonance circuit. As is known, a parallel resonance circuit is characterized in that a zero-point and a peak alternately appears when an angular frequency varies, whereas a series resonance circuit is characterized in that zero-points can be positioned adjacent to each other, resulting in that a wide band width can be obtained.

Figure 8A:
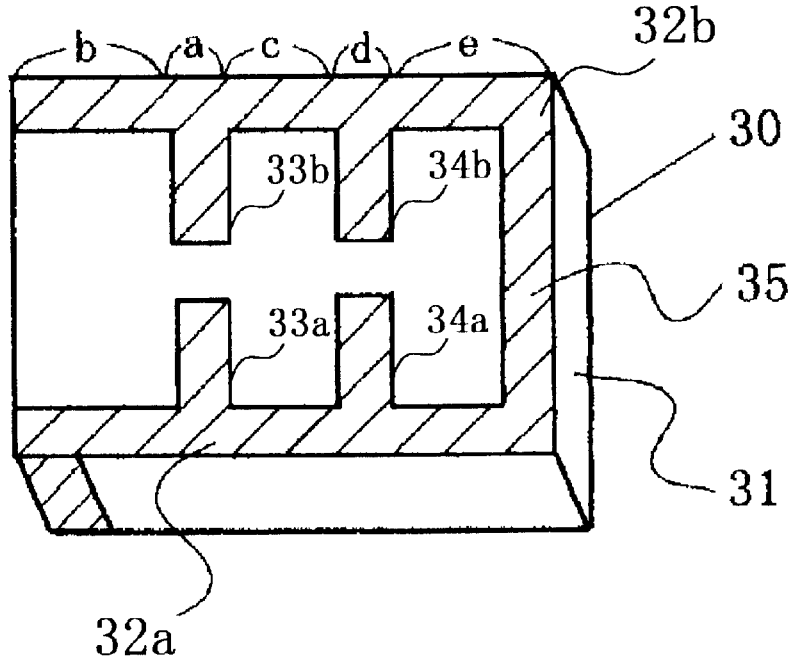
FIG. 8A is a perspective view of the chip antenna in accordance with the third embodiment of the present invention.
Figure 8B:
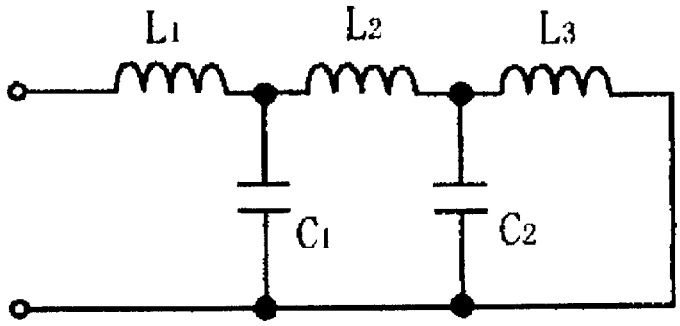
FIG. 8B is a circuit diagram of an equivalent circuit equivalent to the chip antenna illustrated in FIG. 8A.

FIG. 5A is a perspective view of the chip antenna 30 in accordance with the third embodiment, and FIG. 8B is a circuit diagram of an equivalent circuit equivalent to the chip antenna 30. As illustrated in FIG. 8B, an equivalent circuit equivalent to the chip antenna 30 is comprised of a parallel resonance circuit.

As illustrated in FIG. 8A, the chip antenna 30 is comprised of a rectangular-parallelopiped dielectric substrate 31, a first electrical conductor 32*a* printed onto a front surface of the dielectric substrate 31 so that the first electrical conductor 32*a* extends along a lower edge of the front surface of the dielectric substrate 31, a second electrical conductor 32*b* printed onto the front surface of the dielectric substrate 31 so that the second electrical conductor 32*b* extends along an upper edge of the front surface of the dielectric substrate 31, a third electrical conductor 35 printed onto the front surface of the dielectric substrate 31 so that the third electrical conductor 35 extends along a right edge of the front surface of the dielectric substrate 31 to thereby electrically connect the first and second electrical conductors 32*a* and 32*b* to each other at their right ends, a first extension 33*a* extending from the first electrical conductor 22*a* towards the second electrical conductor 22*b*, and having a width "a", a second extension 33*b* extending from the second electrical conductor 22*b* towards the first electrical conductor 22*a*, and having a width "a", a third extension 34*a* extending from the first electrical conductor 22*a* towards the second electrical conductor 22*b*, and having a width "d", and a fourth extension 34*b* extending from the second electrical conductor 22*b* towards the first electrical conductor 22*a*, and having a width "d", The first and second extensions 33*a* and 33*b* are in alignment with each other to narrow a gap between the first and second electrical conductors 32*a* and 32*b* to thereby define a capacitance C1 therebetween. Similarly, the third and fourth extensions 34*a* and 34*b* are in alignment with each other to narrow a gap between the first and second electrical conductors 32*a* and 32*b* to thereby define a capacitance C2 therebetween.

The first and second electrical conductors 32*a* and 32*b* define inductances L1, L2 and L3 at lengths "b", "c" and "e", respectively.

If the capacitance C2 and the inductance L3 are determined such that they are resonated at a frequency of 2.4 GHz, the chip antenna 30 is resonated at a resonance frequency defined by the inductance L1 and the capacitance C1 at a frequency of 2.4 GHz. Hence, if the inductance L1 and the capacitance C1 are determined such that they are resonated at a frequency of 2.4 GHz, and farther if the inductance L2 is determined such that the chip antenna 30 is resonated at a frequency of 1.9 GHz, for instance, the chip antenna 30 would be resonated at frequencies of 2.4 GHz and 1.9 GHz.

By modifying or combining the above-mentioned first to third embodiments, a lot of variants of the chip antenna and the antenna unit can be obtained. Hereinbelow, some of them are explained.

[Fourth Embodiment]

Figure 9A:
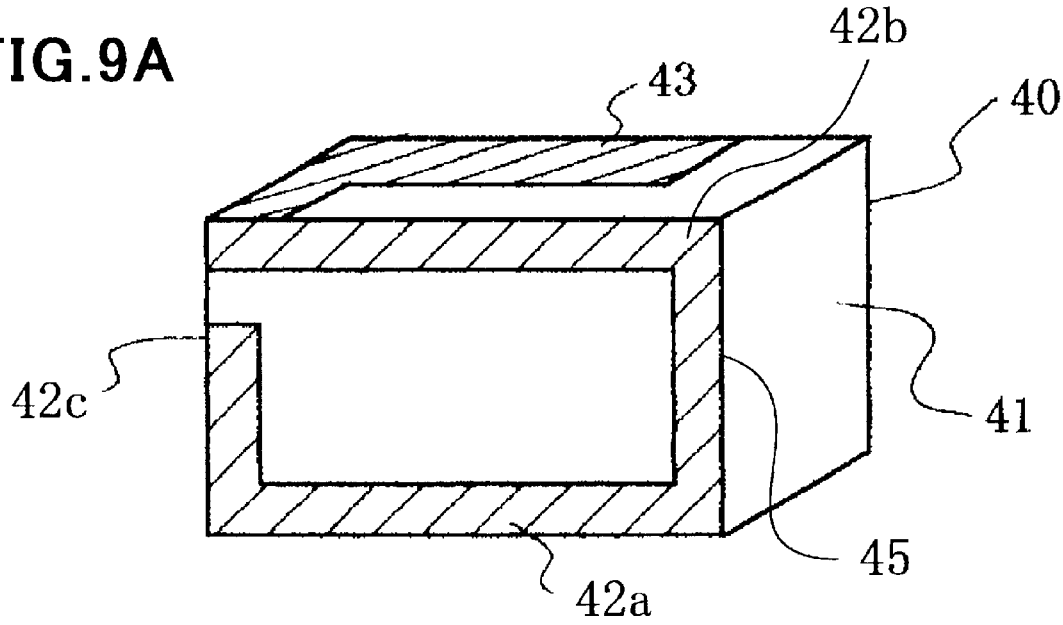
FIG. 9A is a perspective view of the chip antenna in accordance with the fourth embodiment of the present invention.
Figure 9B:
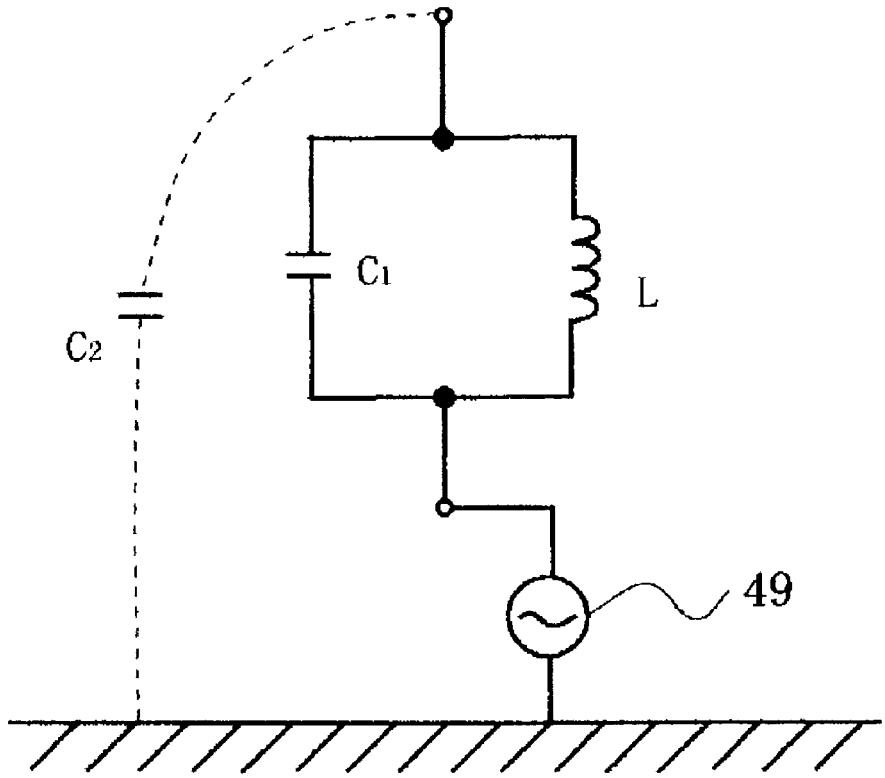
FIG. 9B is a circuit diagram of an equivalent circuit equivalent to the chip antenna illustrated in FIG. 9A.

FIG. 9A is a perspective view of the chip antenna 40 in accordance with the fourth embodiment, and FIG. 9B is a circuit diagram of an equivalent circuit equivalent to the chip antenna 40.

The chip antenna 40 is comprised of a rectangular-parallelopiped dielectric substrate 41, a first electrical conductor 42*a* printed onto a front surface of the dielectric substrate 41 so that the first electrical conductor 42*a* extends along a lower edge of the front surface of the dielectric substrate 41, a second electrical conductor 42*b* printed onto the front surface of the dielectric substrate 41 so that the second electrical conductor 42*b* extends along an upper edge of the front surface of the dielectric substrate 41, a third electrical conductor 45 printed onto the front surface of the dielectric substrate 41 so that the third electrical conductor 45 extends along a right edge of the front surface of the dielectric substrate 41 to thereby electrically connect the first and second electrical conductors 42*a* and 42*b* to each other at their right ends, an extension 42*c* extending from an open end of the first electrical conductor 42*a* along a left edge of the front surface of the dielectric substrate 41, and a capacitive plate 43 printed onto an upper surface of the dielectric substrate 41.

In comparison with the chip antenna 20 illustrated in FIG. 4, the chip antenna 40 additionally includes the extension 42*c*.

As is obvious in view of FIG. 9B, the equivalent circuit equivalent to the chip antenna 40 includes a parallel circuit having an inductance L defined by the first and second electrical conductors 42*a* and 42*b* and a capacitance C1 defined by the extension 42*c*, which parallel circuit is electrically connected in series to a capacitance C2 defined by the capacitive plate 48.

An input impedance Z is defined in accordance with the following equation, when viewed from a power feeder 49.

$$Z=-j/\omega C2+j\omega L/(1-LC1\ \omega^2) \quad \text{(C)}$$

As is obvious in view of the equation (C), when an angular frequency is smaller than $1/(LC1)^{1/2}$, the inductance defined by the term "$j\omega L/(1-LC1\omega^2)$" could be increased by making the term $(1-LC1\omega^2)$ close to zero. By varying an inductance through the use of a capacitance, as mentioned above, it would be possible to reduce an inductance L of the input impedance, ensuring that a current is prevented from running on a surface of the electrical conductors, and that a high efficiency and reduction in power consumption can be accomplished.

[Fifth Embodiment]

Figure 10:
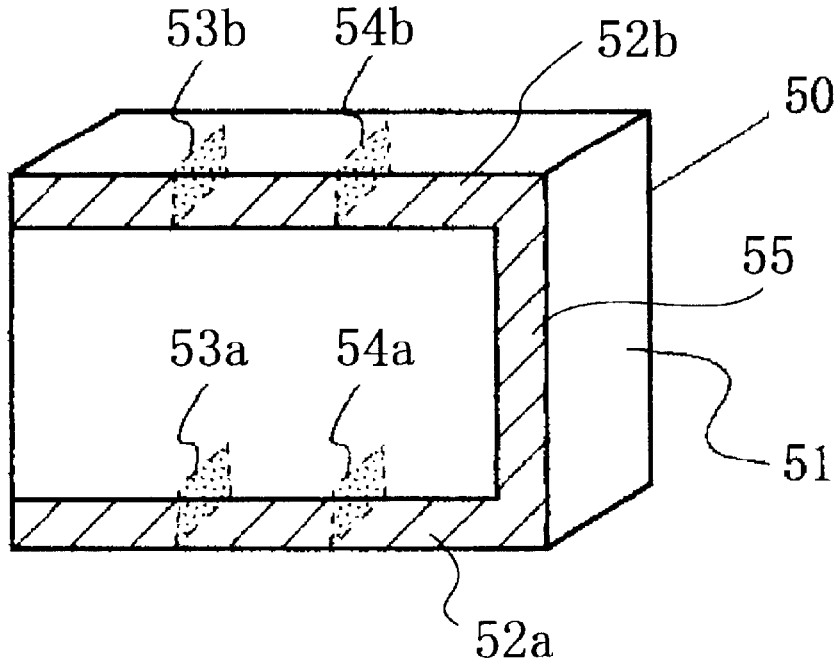
FIG. 10 is a perspective view of the chip antenna in accordance with the fifth embodiment of the present invention.

FIG. 10 is a perspective view of the chip antenna 50 in accordance with the fifth embodiment.

The chip antenna 50 is comprised of a rectangular-parallelopiped dielectric substrate 51, a first electrical conductor 52*a* printed onto a front surface of the dielectric substrate 51 so that the first electrical conductor 52*a* extends along a lower edge of the front surface of the dielectric substrate 41, a second electrical conductor 62*b* printed onto the front surface of the dielectric substrate 51 so that the second electrical conductor 52*b* extends along an upper edge of the front surface of the dielectric substrate 51, a third electrical conductor 55 printed onto the front surface of the dielectric substrate 51 so that the third electrical conductor 55 extends along a right edge of the front surface of the dielectric substrate 51 to thereby electrically, connect the first and second electrical conductors 52*a* and 52*b* to each other at their right ends, first and second extensions 53*a* and 54*a* both extending from the first electrical conductor 52*a* in parallel with each other in a thickness-wise direction of the dielectric substrate 51, and third and fourth extensions 53*b* and 54*b* both extending from the second electrical conductor 52*b* in parallel with each other in a thickness-wise direction of the dielectric substrate 51.

The first to fourth extensions 53*a*, 54*a*, 53*b* and 54*b* are designed to have the same length. The third extension 53*b* is located in alignment with the first extension 53*a*, and the fourth extension 54*b* is located in alignment with the second extension 54*a*. A gap between the first and second extensions 53*a* and 54*a* is equal to a gap between the third and fourth extensions 53*b* and 54*b*.

A capacitance corresponding to the capacitance C1 illustrated in FIG. 8B is defined by the first and third extensions 53*a* and 53*b*, and a capacitance corresponding to the capacitance C2 illustrated in FIG. 5B is defined by the second and fourth extensions 54*a* and 54*b*.

In accordance with the chip antenna 50, the first and second electrical conductors 52*a* and 52*b* can be formed shorter than the first and second electrical conductors 32*a* and 32*b* illustrated in FIG. 8A. Accordingly, the fifth embodiment is suitable particularly to the chip antenna 30 including a plurality of extensions 33*a*, 33*b*, 34*a* and 34*b* for defining a capacitance.

[Sixth Embodiment]

Figure 11A:
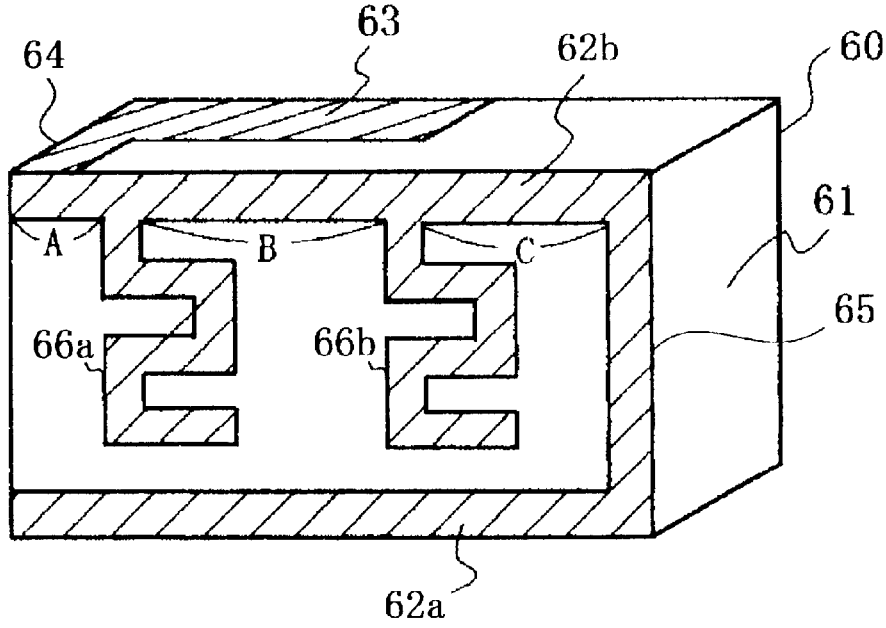
FIG. 11A is a perspective view of the chip antenna in accordance with the sixth embodiment of the present invention.
Figure 11B:
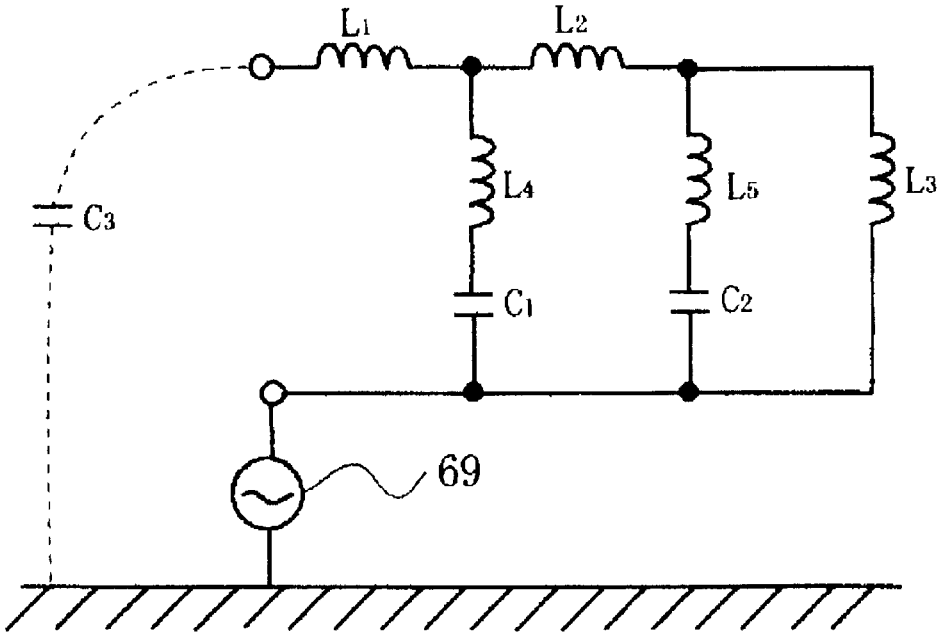
FIG. 11B is a circuit diagram of an equivalent circuit equivalent to the chip antenna illustrated in FIG. 11A.

FIG. 11A is a perspective view of the chip antenna 60 in accordance with the sixth embodiment, and FIG. 11B is a circuit diagram of an equivalent circuit equivalent to the chip antenna 60.

With reference to FIG. 11A, the chip antenna 60 is comprised of a rectangular-parallelopiped dielectric substrate 61, a first electrical conductor 62*a* printed onto a front surface of the dielectric substrate 61 so that the first electrical conductor 62*a* extends along a lower edge of the front surface of the dielectric substrate 61, a second electrical conductor 62*b* printed onto the front surface of the dielectric substrate 61 so that the second electrical conductor 62*b* extends along an upper edge of the front surface of the dielectric substrate 61, a third electrical conductor 65 printed onto the front surface of the dielectric substrate 61 so that the third electrical conductor 65 extends along a right edge of the front surface of the dielectric substrate 61 to thereby electrically connect the first and second electrical conductors 62*a* and 62*b* to each other at their right ends, a first mianda line 66*a* extending from the second electrical conductor 62*b* towards the first electrical conductor 62*a*, a second mianda line 66*b* extending from the second electrical conductor 62*b* towards the first electrical conductor 62*a*, and a capacitive plate 63 printed onto an upper surface of the dielectric substrate 61.

The first and second mianda lines 66*a* and 66*b* are designed to have a plurality of cranks in order to ensure a high inductance, and may be designed to be linear, if it is not necessary to ensure a high inductance.

The inductances L1, L2, L3, L4 and L5 illustrated in FIG. 11B are defined by portions A, B and C of the second electrical conductor 62*b* and the first and second mianda lines 66*a* and 66*b*, respectively, and the capacitances C1 and C2 illustrated in FIG. 11B are defined by the first and second mianda lines 66*a* and 66*b*, and the capacitive plate 63, respectively.

If the first mianda line 66*a* is designed as a series resonance system which resonates at a frequency of 2.4 GHz, and the portion A has such a length that the portion A resonates at a frequency of 2.4 GHz, the portion D would be in short-circuited condition at a frequency of 2.4 GHz, and accordingly, the chip antenna 60 would resonate at a frequency of 2.4 GHz. As an alternative, if the second mianda line 66*b* is designed as a series resonance system which resonates at a frequency of 1.9 GHz, and the portions A and B have such a length that the portions A and B resonate at a frequency of 2.4 GHz, the portion D would be in short-circuited condition at a frequency of 1.9 GHz, and accordingly, the chip antenna 60 would resonate at a frequency of 1.9 GHz. Since the first and second mianda lines 66a and 66b are not short-circuited at frequencies other than 2.4 GHz and 1.9 GHz, the chip antenna 60 carries out two-frequency operation.

[Seventh Embodiment]

In the above-mentioned first to sixth embodiments, the first to third electrical conductors were printed onto a surface of or inside the dielectric substrate. However, it should be noted that they might be printed not onto a surface of a dielectric substrate, but onto a surface of a circuit board. In particular, if a circuit board is composed of a material having a high dielectric constant, it would be possible to fabricate a chip antenna in a small size, even if electrical conductors were printed directly onto a surface of a circuit board, in which case, it would not be necessary to add a dielectric chip to the chip antenna, and hence, electrical conductors can be printed onto a surface of a circuit board at the same time when wiring circuits are printed onto a surface of the circuit board, ensuring significant reduction in the number of fabrication steps.

Figure 12:
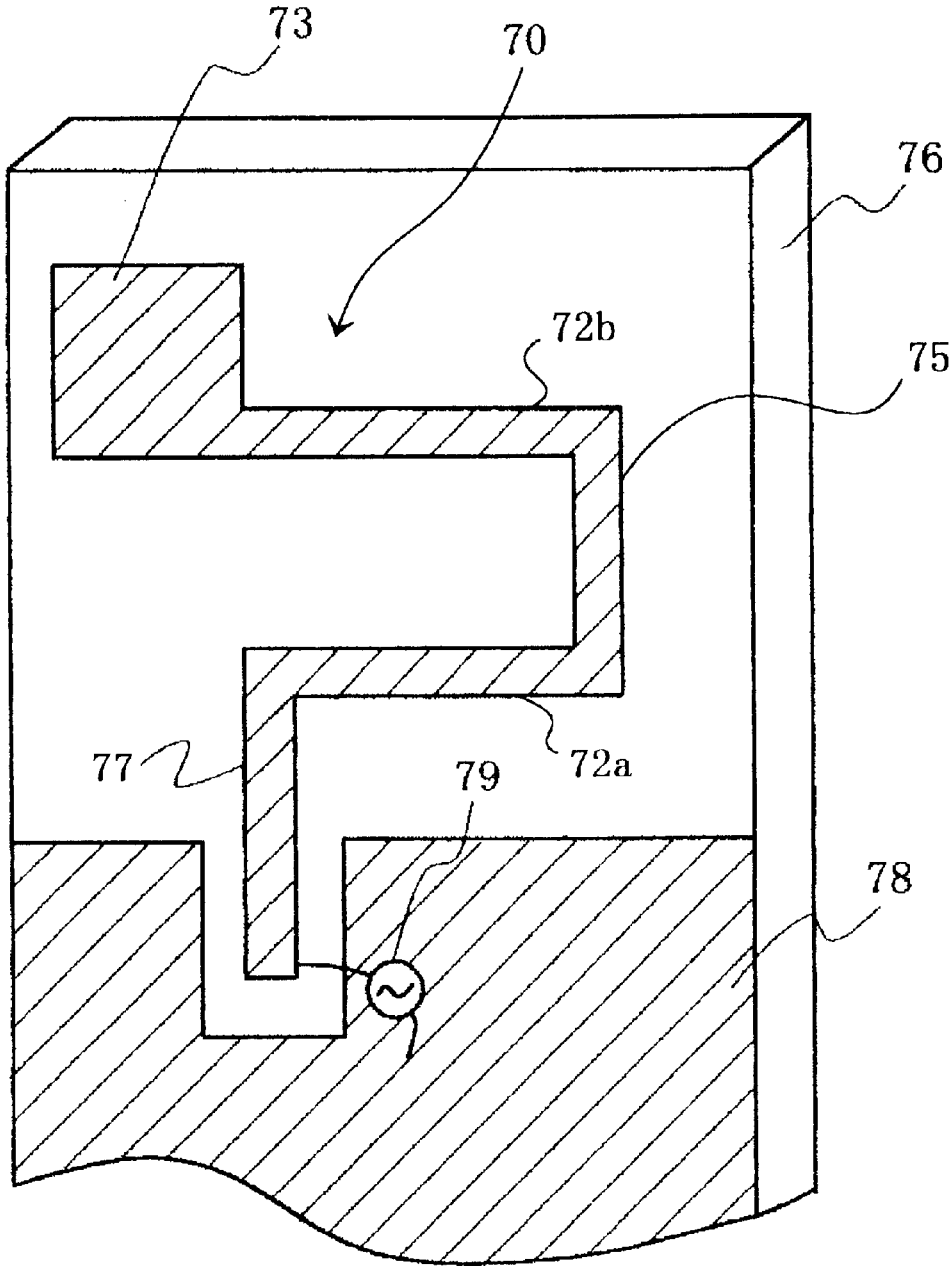
FIG. 12 is a perspective view of the antenna unit in accordance with the seventh embodiment of the present invention.

FIG. 12 is a perspective view of an antenna unit including the chip antenna 70 in accordance with the seventh embodiment.

The antenna unit is comprised of the chip antenna 70, a circuit board 76 on which the chip antenna 70 is formed by printing, a ground electrode 78 printed on a surface of the circuit board 76, and a power-feeder 79 electrically connected the ground electrode and a later mentioned power-feeding line 77 to each other.

The chip antenna 70 is comprised of a first electrical conductor 72*a* having a first end, a second electrical conductor 72*b* extending in parallel with the first electrical conductor 72*a* and having a second end located in alignment with the first end, and a third electrical conductor 75 extending between the first end of the first electrical conductor 72a and the second end of the second electrical conductor 72*b* perpendicularly to the first and second electrical conductors 72*a* and 72*b*, a power-feeding line 77 electrically connected to the second electrical conductors 72*b* at the other end thereof, and extending in parallel with the third electrical conductor 75, and a capacitive plate 73 formed in continuation with an open end of the second electrical conductor 72*b*.

The capacitive plate 73 provides the same advantages as those provided by the capacitive plate 23, for instance. Though the capacitive plate 73 is formed in continuation with a left end of the second electrical conductor 72*b* in the seventh embodiment, the capacitive plate 73 may be formed between a left end and the first end of the second electrical conductor 72*b*, or may be formed on an upper surface of the circuit board 76.

The power-feeding line 77 corresponds to the power-feeding line 13 illustrated in FIG. 3A, the ground electrode 78 corresponds to the ground electrode 28 illustrated in FIG. 6A, and the power-feeder 79 corresponds to the power-feeder 16 illustrated in FIG. 3B.

It is not always necessary for the chip antennas in accordance with the above-mentioned first to seventh embodiments to include the capacitive plates. This is because since the first and second electrical conductors 72*a* and 72*b*, for instance, which are short-circuited to each other through the third electrical conductor 75, would have an inductance of zero at a frequency of electromagnetic waves having a wavelength equal to 4L wherein L indicates a length of the first and second electrical conductors 72*a* and 72*b*, and hence, would be resonated, the first and second electrical conductors 72*a* and 72*b* can be designed to have such a length L.

The capacitive plate 73 is used for the purpose of shortening the first and second electrical conductors 72*a* and 72*b*. Though the chip antenna 30 illustrated in FIG. 8A and the chip antenna 50 illustrated in FIG. 10 are not designed to have a capacitive plate, they may be designed to have a capacitive plate.

[Eighth Embodiment]

The ground electrode 28 illustrated in FIG. 6A may be formed in a micro-strip line. Since a circuit board has a ground area on a lower surface thereof, a chip antenna is mounted generally on an upper surface of the circuit board on which parts are mounted. Though a ground electrode is generally indispensable for feeding power to a mono-pole antenna, a ground electrode causes a problem that a ground electrode is electromagnetically coupled with electrical conductors constituting an antenna to thereby generate a current running on a surface of the electrical conductors and further generate a distributed capacitance, resulting in loss in radio-frequency and reduction in a band width.

Figures 13A, 13B, 13C:
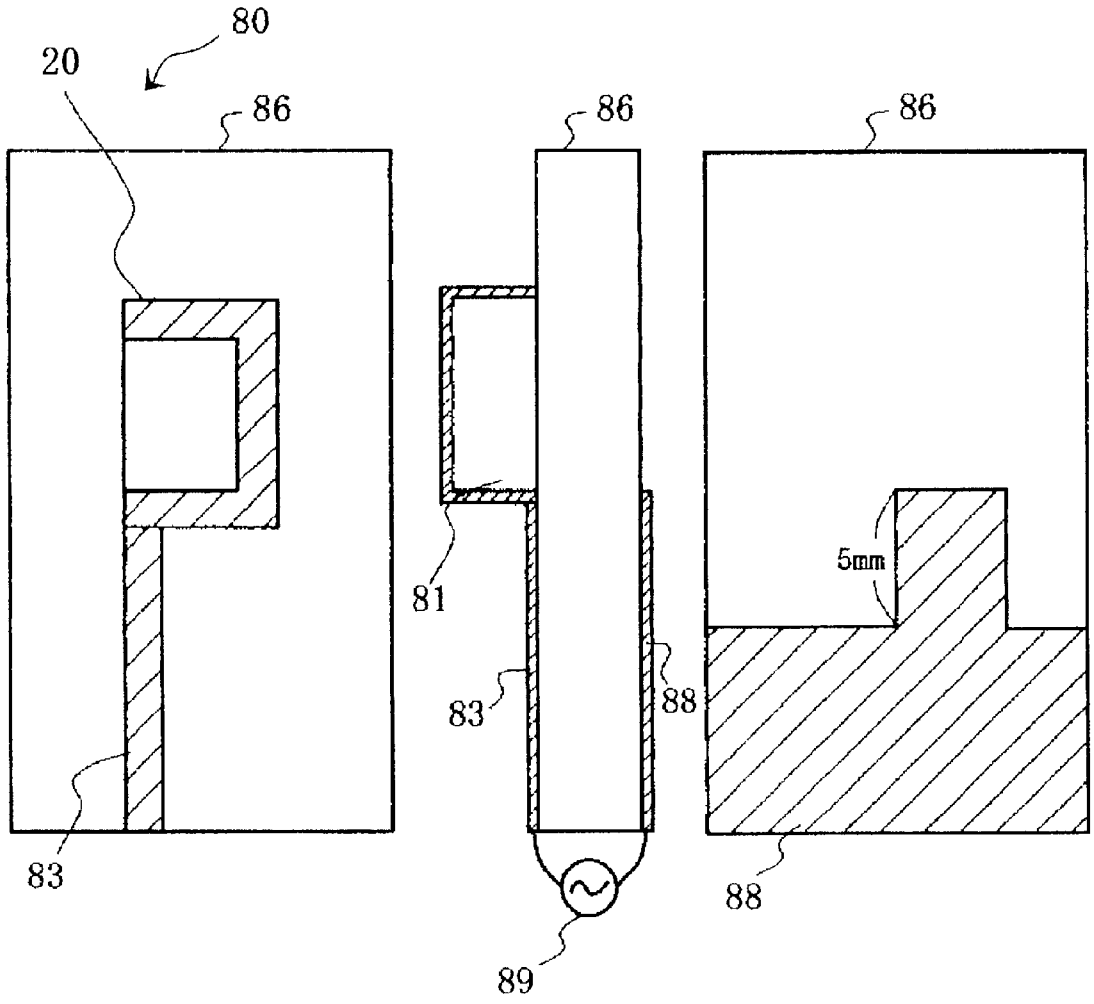
FIG. 13A is a plan view of the antenna unit in accordance with the eighth embodiment of the present invention.
FIG. 13B is a side view of the antenna unit illustrated in FIG. 13A.
FIG. 13C is a rear view of the antenna unit illustrated in FIG. 13A.

FIGS. 13A to 13C illustrate an antenna unit 80 in accordance with the eighth embodiment having a micro strip line structure. The antenna unit 80 in accordance with the eighth embodiment solves the above-mentioned problem. FIG. 13A is a front view of the antenna unit 80, FIG. 13B is a side view of the antenna unit 80, and FIG. 13C is a rear view of the antenna unit 80.

The antenna unit 80 is comprised of the chip antenna 20 illustrated in FIG. 4, a circuit board 86 having an upper surface on which the chip antenna 20 is mounted, and a lower surface, a power-feeding line 83 formed on the upper surface of the circuit board 86 so that the power-feeding line 83 is electrically connected to the chip antenna 20, a ground electrode 88 formed on the lower surface of the circuit board 86, and a power-feeder 89 electrically connecting the power-feeding line 83 and the ground electrode 88 to each other.

As illustrated in FIG. 13C, the ground electrode 88 is not printed onto the lower surface of the circuit board 86 in an area from an upper edge of the circuit board 86 to a line spaced away from a lower edge of a dielectric substrate 81 by 5 mm except a minimum area necessary for power-feeding.

The minimum area in which the ground electrode 88 is printed has a width sufficient to cover a width of the power-feeding line 83 formed on the upper surface of the circuit board 86. In the antenna unit 80, the ground electrode 88 acts as a part of the chip antenna 20, and radiates electromagnetic waves. The power feeder 89 corresponds to the power-feeder 29 illustrated in FIG. 6A.

[Ninth Embodiment]

The dielectric substrate in the above-mentioned first to eighth embodiments is rectangular-parallelopiped. However, if a chip antenna is not to be mounted on a circuit board, a dielectric substrate may be a cube, a cylinder or a polygonal pole.

Figure 14:
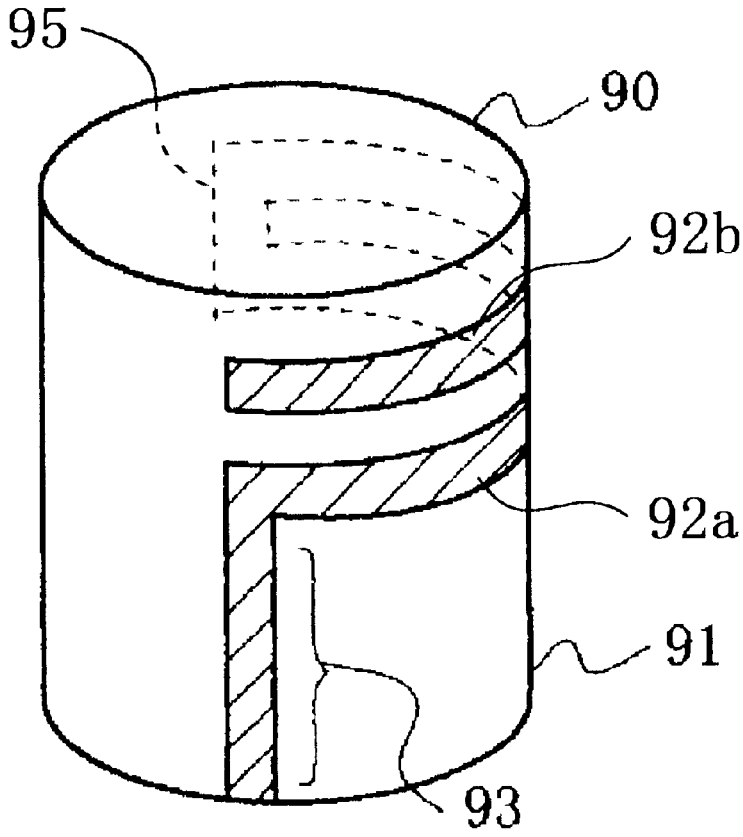
FIG. 14 is a perspective view of the antenna unit in accordance with the ninth embodiment of the present invention.

FIG. 14 is a perspective view of a chip antenna 90 in accordance with the ninth embodiment.

The chip antenna 90 is comprised of a cylindrical dielectric substrate 91 composed of ceramic, a first electrical conductor 92*a,* a second electrical conductor 92*b* extending in parallel with the first electrical conductor 92*a,* a third electrical conductor 95 extending between the first electrical conductor 92*a* and the second electrical conductor 92*b* perpendicularly to them to thereby electrically connect them to each other at their right ends, and a power-feeding line 93 electrically connected to the second electrical conductors 92*b* at an open end thereof, and extending in parallel with the third electrical conductor 95.

The chip antenna 90 is structurally different from the chip antenna 10 in accordance with the first embodiment in a shape of the dielectric substrate 90, but would provide the same advantages as those obtained by the chip antenna 10.

The chip antenna 10 in accordance with the first embodiment, illustrated in FIG. 3A, the chip antenna 30 in accordance with the third embodiment, illustrated in FIG. BA, the chip antenna 40 in accordance with the fourth embodiment, illustrated i n FIG. 9A, the chip antenna 50 in accordance with the f fifth embodiment, illustrated in FIG. 10, and the chip antenna 60 in accordance with the sixth embodiment, illustrated in FIG. 11A are not explained as a part of an antenna unit, but they may be mounted on a circuit board to thereby form an antenna unit. As an alternative, those chip antennas may be designed to have a micro-strip-line structure, as the antenna unit 80 illustrated in FIGS. 13A to 13C.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2001-026002 filed on Feb. 1, 2001 including specification, claims, drawings and summary is incorporated herein by reference in its entirety.

What is claimed is:

1. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors; and a power feed line which feeds power to one of said first and second electrical conductors, and is parallel to said third electrical conductor, wherein said first to third electrical conductors are integrally formed, and wherein said first and second electrical conductors comprise third and fourth ends, respectively, which are substantially aligned.

2. The chip antenna as set forth in claim 1, further comprising:

a dielectric substrate, said first to third electrical conductors are formed in said dielectric substrate.

3. The chip antenna as set forth in claim 2, wherein said first to third electrical conductors are formed on a surface of said dielectric substrate.

4. The chip antenna as set forth in claim 2, further comprising a capacitive plate defining a capacitance between said capacitive plate and a ground and electrically connected to one of said first and second electrical conductors, said capacitive plate being formed on a surface of said dielectric substrate other than a surface of said dielectric substrate on which said first to third electrical conductors are formed.

5. The chip antenna as set forth in claim 2, wherein said first to third electrical conductors are formed on a surface of said dielectric substrate by printing.

6. The chip antenna as set forth in claim 2, wherein said dielectric substrate comprises one of a rectangular-parallelopiped, a cubic, a cylinder, and a polygonal pole in shape.

7. The chip antenna as set forth in claim 1, further comprising a circuit board on which said first to third electrical conductors are formed.

8. The chip antenna as set forth in claim 7, wherein said first to third electrical conductors are formed on a surface of said circuit board by printing.

9. The chip antenna as set forth in claim 7, further comprising a capacitive plate defining a capacitance between said capacitive plate and a ground, said capacitive plate being formed on a surface of said circuit board on which said first to third electrical conductors are formed.

10. The chip antenna as set forth in claim 7, further comprising a capacitive plate defining a capacitance between said capacitive plate and a ground and electrically connected to one of said first and second electrical conductors, said capacitive plate being formed on a surface of said circuit board other than a surface of said dielectric substrate on which said first to third electrical conductors are formed.

11. The chip antenna as set forth in claim 1, further comprising at least one meander line comprising an open end and extending from one of said first and second electrical conductors to the other.

12. The chip antenna as set forth in claim 1, wherein said first and second electrical conductors are formed in a line.

13. The chip antenna as set forth in claim 1, wherein said first and second electrical conductors are formed in a curve.

14. The chip antenna as set forth in claim 1, wherein said first and second electrical conductors comprise a length at most equal to a quarter wavelength of an electromagnetic wave emitted from said chip antenna.

15. The chip antenna according to claim 1, wherein said first and second electrical conductors are formed in straight lines.

16. The chip antenna according to claim 1, wherein said first and second electrical conductors comprise substantially equal lengths.

17. A chip antenna, comprising:

a first electrical conductor comprising a first end;

a second electrical conductor extending in parallel with said first electrical conductor and comprising a second end located in alignment with said first end; and a third electrical conductor extending between said first and second ends perpendicularly to said first and second electrical conductors, wherein said first to third electrical conductors are integrally formed, power is fed through said power feed line to one of said first and second electrical conductors, and wherein at least one capacitor is integrally formed in one of said first and second electrical conductors.

18. The chip antenna as set forth in claim 17, wherein said capacitor comprises at least one first extension extending from said first electrical conductor to said second electrical conductor, and at least one second extension extending from said second electrical conductor to said first electrical conductor such that said first and second extensions are in alignment with each other.

19. The chip antenna as set forth in claim 17, wherein said capacitor comprises at least one extension extending from one of said first and second electrical conductors to the other.

20. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power feed line which feeds power to one of said first and second electrical conductors, and is parallel to said third electrical conductor; and a dielectric substrate, said first to third electrical conductors are formed in said dielectric substrate, wherein said first to third electrical conductors are integrally formed, and wherein said first to third electrical conductors are formed inside said dielectric substrate.

21. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power feed line which feeds power to one of said first and second electrical conductors, and is parallel to said third electrical conductor;

a dielectric substrate, said first to third electrical conductors being formed in said dielectric substrate; and at least one capacitor which extends perpendicularly to said first to third electrical conductors in a thickness-wise direction of said dielectric substrate.

22. A chip antenna, comprising:

first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power feed line which feeds power to one of said first and second electrical conductors, and is parallel to said third electrical conductor, said first to third electrical conductors being integrally formed; and a capacitive plate defining a capacitance between said capacitive plate and a ground.

23. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power feed line which feeds power to one of said first and second electrical conductors, and is parallel to said third electrical conductor;

a dielectric substrate, said first to third electrical conductors being formed in said dielectric substrate; and a capacitive plate defining a capacitance between said capacitive plate and a ground, said capacitive plate is formed on a surface of said dielectric substrate on which said first to third electrical conductors are formed.

24. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors; and a power feed line which feeds power to one of said first and second electrical conductors, and is parallel to said third electrical conductor, wherein said first to third electrical conductors are integrally formed, and wherein said first and second electrical conductors are thinner than said third electrical conductor.

25. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors; and a power-feeding line electrically connected to one of said first and second electrical conductors and extending in parallel with said third electrical conductor, said first to third electrical conductors and said power-feeding line are integrally formed, power being fed to one of said first and second electrical conductors through said power-feeding line, and wherein said first and second electrical conductors comprise third and fourth ends, respectively, which are substantially aligned.

26. The chip antenna as set forth in claim 25, further comprising a dielectric substrate, said first to third electrical conductors being formed anywhere in said dielectric substrate.

27. The chip antenna as set forth in claim 26, wherein said first to third electrical conductors are formed on a surface of said dielectric substrate.

28. The chip antenna as set forth in claim 26, further comprising at least one capacitor extending perpendicularly to said first to third electrical conductors in a thickness-wise direction of said dielectric substrate.

29. The chip antenna as set forth in claim 26, further comprising a capacitive plate defining a capacitance between said capacitive plate and a ground, said capacitive plate being formed on a surface of said dielectric substrate on which said first to third electrical conductors are formed.

30. The chip antenna as set forth in claim 26, further comprising a capacitive plate defining a capacitance between said capacitive plate and a ground and electrically connected to one of said first and second electrical conductors, said capacitive plate being formed on a surface of said dielectric substrate other than a surface of said dielectric substrate on which said first to third electrical conductors are formed.

31. The chip antenna as set forth in claim 26, wherein said first to third electrical conductors are formed on a surface of said dielectric substrate by printing.

32. The chip antenna as set forth in claim 26, wherein said dielectric substrate comprises one of a rectangular-parallelopiped, a cubic, a cylinder, and a polygonal pole in shape.

33. The chip antenna as set forth in claim 26, wherein said first and second electrical conductors are formed in a line.

34. The chip antenna as set forth in claim 26, wherein said first and second electrical conductors are formed in a curve.

35. The chip antenna as set forth in claim 26, wherein said first and second electrical conductors comprise a length at most equal to a quarter wavelength of an electromagnetic wave emitted from said chip antenna.

36. The chip antenna as set forth in claim 25, further comprising a circuit board on which said first to third electrical conductors are formed.

37. The chip antenna as set forth in claim 36, wherein said power-feeding line is formed on a surface of said circuit board on which said first to third electrical conductors are formed.

38. The chip antenna as set forth in claim 36, wherein said first to third electrical conductors are formed on a surface of said circuit board by printing.

39. The chip antenna as set forth in claim 36, further comprising a capacitive plate defining a capacitance between said capacitive plate and a ground and electrically connected to one of said first and second electrical conductors, said capacitive plate being formed on a surface of said circuit board other than a surface of said dielectric substrate on which said first to third electrical conductors are formed.

40. The chip antenna as set forth in claim 25, further comprising at least one capacitor integrally formed in one of said first and second electrical conductors.

41. The chip antenna as set forth in claim 25, further comprising at least one meander line comprising an open end and extending from one of said first and second electrical conductors to the other.

42. The chip antenna as set forth in claim 25, further comprising a capacitive plate defining a capacitance between said capacitive plate and a ground.

43. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power-feeding line electrically connected to one of said first and second electrical conductors and extending in parallel with said third electrical conductor, said first to third electrical conductors and said power-feeding line being integrally formed, power being fed to one of said first and second electrical conductors through said power-feeding line; and a dielectric substrate, wherein said first to third electrical conductors are formed inside said dielectric substrate.

44. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power-feeding line electrically connected to one of said first and second electrical conductors and extending in parallel with said third electrical conductor, said first to third electrical conductors and said power-feeding line being integrally formed power being fed to one of said first and second electrical conductors through said power-feeding line; and at least one capacitor integrally formed in one of said first and second electrical conductors, wherein said capacitor comprises at least one first extension extending from said first electrical conductor to said second electrical conductor and at least one second extension extending from said second electrical conductor to said first electrical conductor such that said first and second extensions are in alignment with each other.

45. A chip antenna comprising:

a first electrical conductor comprising a first end:

a second electrical conductor extending in parallel with said first electrical conductor and comprising a second end located in alignment with said first end:

a third electrical conductor extending between said first and second ends perpendicularly to said first and second electrical conductors:

a power-feeding line electrically connected to one of said first and second electrical conductors and extending in parallel with said third electrical conductor, said first to third electrical conductors and said power-feeding line being integrally formed, power being fed to one of said first and second electrical conductors through said power-feeding line; and at least one capacitor being integrally formed in one of said first and second electrical conductors, wherein said capacitor comprises at least one extension extending from one of said first and second electrical conductors to the other.

46. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power-feeding line electrically connected to one of said first and second electrical conductors and extending in parallel with said third electrical conductor, said first to third electrical conductors and said power-feeding line being integrally formed, power being fed to one of said first and second electrical conductors through said power-feeding line; and a dielectric substrate, said first to third electrical conductors are formed anywhere in said dielectric substrate, wherein said first and second electrical conductors are thinner than said third electrical conductor.

47. A chip antenna, comprising:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors;

a power-feeding line electrically connected to one of said first and second electrical conductors and extending in parallel with said third electrical conductor, said first to third electrical conductors and said power-feeding line being integrally formed, power being fed to one of said first and second electrical conductors through said power-feeding line;

a circuit board on which said first to third electrical conductors are formed; and a capacitive plate defining a capacitance between said capacitive plate and a ground, said capacitive plate being formed on a surface of said circuit board on which said first to third electrical conductors are formed.

48. An antenna unit, comprising:

a chip antenna; and a circuit board comprising a ground area and a non-ground area on a surface thereof, wherein said chip antenna is mounted on a surface of said circuit board such that a power-feeding line of said chip antenna is located in said non-ground area and said ground area acts as a ground plate by which said chip antenna is grounded, said chip antenna including:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors; and a power-feeding line electrically connected to one of said first and second electrical conductors and extending in parallel with said third electrical conductor, said first to third electrical conductors and said power-feeding line being integrally formed, power being fed to one of said first and second electrical conductors through said power-feeding line.

49. The antenna unit as set forth in claim 48, wherein said chip antenna further includes a dielectric substrate, said first to third electrical conductors being formed in said dielectric substrate.

50. The antenna unit as set forth in claim 48, wherein said chip antenna further includes a circuit board on which said first to third electrical conductors are formed.

51. An antenna, unit comprising:

a chip antenna; and a circuit board comprising first and second surfaces oppositely facing each other, wherein said chip antenna is mounted on said first surface of said circuit board, said circuit board comprises a ground area and a non-ground area on said second surface, both said ground area and said non-ground area on said second are surface located in alignment with a power-feeding line of said chip antenna and act as a ground plate by which said chip antenna is grounded, and said chip antenna is located in an area in alignment with said non-ground area, said chip antenna including:

a first electrical conductor comprising a first end;

a second electrical conductor extending in parallel with said first electrical conductor and comprising a second end located in alignment with said first end;

a third electrical conductor extending between said first and second ends perpendicularly to said first and second electrical conductors; and a power-feeding line electrically connected to one of said first and second electrical conductors and extending in parallel with said third electrical conductor, said first to third electrical conductors and said power-feeding line being integrally formed, power being fed to one of said first and second electrical conductors through said power-feeding line.

52. The antenna unit as set forth in claim 51, wherein said chip antenna further includes a dielectric substrate, said first to third electrical conductors being formed in said dielectric substrate.

53. The antenna unit as set forth in claim 51, wherein said chip antenna further includes a circuit board on which said first to third electrical conductors are formed.

* * * * *